US006777891B2

(12) United States Patent
Lys et al.

(10) Patent No.: US 6,777,891 B2
(45) Date of Patent: Aug. 17, 2004

(54) METHODS AND APPARATUS FOR CONTROLLING DEVICES IN A NETWORKED LIGHTING SYSTEM

(75) Inventors: Ihor A. Lys, Boston, MA (US); Frederick M. Morgan, Quincy, MA (US)

(73) Assignee: Color Kinetics, Incorporated, Boston, MA (US)

( * ) Notice: Subject to any disclaimer, the term of this patent is extended or adjusted under 35 U.S.C. 154(b) by 2 days.

(21) Appl. No.: 10/158,579

(22) Filed: May 30, 2002

(65) Prior Publication Data

US 2003/0057886 A1 Mar. 27, 2003

Related U.S. Application Data

(63) Continuation-in-part of application No. 09/971,367, filed on Oct. 4, 2001, which is a continuation-in-part of application No. 09/870,193, filed on May 30, 2001, now Pat. No. 6,608,453, and a continuation-in-part of application No. 09/815,418, filed on Mar. 22, 2001, now Pat. No. 6,577,080, which is a continuation of application No. 09/669,121, filed on Sep. 25, 2000, which is a continuation of application No. 09/425,770, filed on Oct. 22, 1999, now Pat. No. 6,150,774, and a continuation-in-part of application No. 09/333,739, filed on Jun. 15, 1999, and a continuation-in-part of application No. 09/215,624, filed on Dec. 17, 1998, now Pat. No. 6,528,954, and a continuation-in-part of application No. 09/213,607, filed on Dec. 17, 1998, now abandoned, and a continuation-in-part of application No. 09/213,189, filed on Dec. 17, 1998, now Pat. No. 6,459,919, and a continuation-in-part of application No. 09/213,581, filed on Dec. 17, 1998, and a continuation-in-part of application No. 09/213,540, filed on Dec. 17, 1998, which is a continuation of application No. 09/213,548, filed on Dec. 17, 1998, now Pat. No. 6,166,496, which is a continuation of application No. 08/920,156, filed on Aug. 26, 1997, now Pat. No. 6,016,038.

(60) Provisional application No. 60/341,476, filed on Oct. 30, 2001, provisional application No. 60/328,867, filed on Oct. 12, 2001, provisional application No. 60/301,692, filed on Jun. 28, 2001, provisional application No. 60/090,920, filed on Jun. 26, 1998, provisional application No. 60/079,285, filed on Mar. 25, 1998, provisional application No. 60/078,861, filed on Mar. 20, 1998, provisional application No. 60/068,792, filed on Dec. 24, 1997, and provisional application No. 60/071,281, filed on Dec. 17, 1997.

(51) Int. Cl.[7] ..... G05F 1/00

(52) U.S. Cl. ..... 315/291

(58) Field of Search ..... 315/291, 292, 315/297, 307, 312, 316, 317; 362/800; 307/36, 38, 40

(56) References Cited

U.S. PATENT DOCUMENTS 2,909,097 A 10/1959 Alden et al.

(List continued on next page.)

FOREIGN PATENT DOCUMENTS

AU 6 267 9 12/1996

(List continued on next page.)

OTHER PUBLICATIONS

"LM117/LM317A/LM317 3–Terminal Adjustable Regulator", National Seminconductor Corporation, May 1997, pp. 1–20.

(List continued on next page.)

*Primary Examiner*—Don Wong
*Assistant Examiner*—Dien A Minh
(74) *Attorney, Agent, or Firm*—Lowrie, Lando & Anastasi, LLP

(57) ABSTRACT

Methods and apparatus for computer-based control of light sources in a networked lighting system. In one example, a plurality of LED-based lighting systems are arranged as computer controllable "light strings." Applications contemplated for such light strings include, but are not limited to, decorative and entertainment-oriented lighting applications (e.g., Christmas tree lights, display lights, theme park lighting, video and other game arcade lighting, etc.). Via computer control, one or more such light strings may provide a variety of complex temporal and color-changing lighting effects. In one example, lighting data is communicated in a given light string in a serial manner, according to a variety of different data transmission and processing schemes. In another example, individual lighting systems of a light string are coupled together via a variety of different conduit configurations to provide for easy coupling and arrangement of multiple light sources constituting the light string. In yet another example, small LED-based lighting systems capable of being arranged in a light string configuration are manufactured as integrated circuits including data processing circuitry and control circuitry for LED light sources, and are packaged along with LEDs for convenient coupling to a conduit to connect multiple lighting systems.

79 Claims, 16 Drawing Sheets

U.S. PATENT DOCUMENTS

| | | | | |
|---|---|---|---|---|
| 3,318,185 | A | | 5/1967 | Kott |
| 3,561,719 | A | | 2/1971 | Grindle |
| 3,586,936 | A | | 6/1971 | McLeroy |
| 3,601,621 | A | | 8/1971 | Ritchie |
| 3,643,088 | A | | 2/1972 | Osteen et al. |
| 3,746,918 | A | | 7/1973 | Drucker et al. |
| 3,789,211 | A | | 1/1974 | Kramer |
| 3,818,216 | A | | 6/1974 | Larraburu |
| 3,832,503 | A | | 8/1974 | Crane |
| 3,858,086 | A | | 12/1974 | Anderson et al. |
| 3,909,670 | A | | 9/1975 | Wakamatsu et al. |
| 3,924,120 | A | | 12/1975 | Cox, III |
| 3,958,885 | A | | 5/1976 | Stockinger et al. |
| 3,974,637 | A | | 8/1976 | Bergey et al. |
| 4,001,571 | A | | 1/1977 | Martin |
| 4,054,814 | A | | 10/1977 | Fegley et al. |
| 4,070,568 | A | | 1/1978 | Gala |
| 4,082,395 | A | | 4/1978 | Donato et al. |
| 4,096,349 | A | | 6/1978 | Donato |
| 4,241,295 | A | | 12/1980 | Williams, Jr. |
| 4,271,408 | A | | 6/1981 | Teshima et al. |
| 4,272,689 | A | | 6/1981 | Crosby et al. |
| 4,273,999 | A | | 6/1981 | Pierpoint |
| 4,298,869 | A | | 11/1981 | Okuno |
| 4,329,625 | A | | 5/1982 | Nishizawa et al. |
| 4,339,788 | A | | 7/1982 | White et al. |
| 4,342,947 | A | | 8/1982 | Bloyd |
| 4,367,464 | A | | 1/1983 | Kurahashi et al. |
| 4,388,567 | A | | 6/1983 | Yamazaki et al. |
| 4,388,589 | A | | 6/1983 | Molldrem, Jr. |
| 4,392,187 | A | | 7/1983 | Bornhorst |
| 4,420,711 | A | | 12/1983 | Takahashi et al. |
| 4,455,562 | A | | 6/1984 | Dolan et al. |
| 4,500,796 | A | | 2/1985 | Quin |
| 4,597,033 | A | | 6/1986 | Meggs et al. |
| 4,622,881 | A | | 11/1986 | Rand |
| 4,625,152 | A | | 11/1986 | Nakai |
| 4,635,052 | A | | 1/1987 | Aoike et al. |
| 4,647,217 | A | | 3/1987 | Havel |
| 4,656,398 | A | | 4/1987 | Michael et al. |
| 4,668,895 | A | | 5/1987 | Schneiter |
| 4,675,575 | A | | 6/1987 | Smith et al. |
| 4,682,079 | A | | 7/1987 | Sanders et al. |
| 4,686,425 | A | | 8/1987 | Havel |
| 4,687,340 | A | | 8/1987 | Havel |
| 4,688,154 | A | | 8/1987 | Nilssen |
| 4,688,869 | A | | 8/1987 | Kelly |
| 4,695,769 | A | | 9/1987 | Schweickardt |
| 4,701,669 | A | | 10/1987 | Head et al. |
| 4,705,406 | A | | 11/1987 | Havel |
| 4,707,141 | A | | 11/1987 | Havel |
| 4,727,289 | A | | 2/1988 | Uchida |
| 4,740,882 | A | | 4/1988 | Miller |
| 4,753,148 | A | | 6/1988 | Johnson |
| 4,771,274 | A | | 9/1988 | Havel |
| 4,780,621 | A | | 10/1988 | Bartleucci et al. |
| 4,794,383 | A | | 12/1988 | Havel |
| 4,818,072 | A | | 4/1989 | Mohebban |
| 4,837,565 | A | | 6/1989 | White |
| 4,843,627 | A | | 6/1989 | Stebbins |
| 4,845,481 | A | | 7/1989 | Havel |
| 4,845,745 | A | | 7/1989 | Havel |
| 4,857,801 | A | | 8/1989 | Farreii |
| 4,863,223 | A | | 9/1989 | Weissenbach et al. |
| 4,870,325 | A | | 9/1989 | Kazar |
| 4,874,320 | A | | 10/1989 | Freed et al. |
| 4,887,074 | A | | 12/1989 | Simon et al. |
| 4,922,154 | A | | 5/1990 | Cacoub |
| 4,934,852 | A | | 6/1990 | Havel |
| 4,962,687 | A | | 10/1990 | Belliveau et al. |
| 4,965,561 | A | | 10/1990 | Havel |
| 4,973,835 | A | | 11/1990 | Kurosu et al. |
| 4,979,081 | A | | 12/1990 | Leach et al. |
| 4,980,806 | A | | 12/1990 | Taylor et al. |
| 4,992,704 | A | | 2/1991 | Stinson |
| 5,003,227 | A | | 3/1991 | Nilssen |
| 5,008,595 | A | | 4/1991 | Kazar |
| 5,008,788 | A | | 4/1991 | Palinkas |
| 5,010,459 | A | | 4/1991 | Taylor et al. |
| 5,027,262 | A | | 6/1991 | Freed |
| 5,034,807 | A | | 7/1991 | Von Kohorn |
| 5,036,248 | A | | 7/1991 | McEwan et al. |
| 5,038,255 | A | | 8/1991 | Nishihashi et al. |
| 5,072,216 | A | | 12/1991 | Grange |
| 5,078,039 | A | | 1/1992 | Tulk et al. |
| 5,083,063 | A | | 1/1992 | Brooks |
| 5,089,748 | A | | 2/1992 | Ihms |
| 5,122,733 | A | | 6/1992 | Havel |
| 5,126,634 | A | | 6/1992 | Johnson |
| 5,128,595 | A | | 7/1992 | Hara |
| 5,130,909 | A | | 7/1992 | Gross |
| 5,134,387 | A | | 7/1992 | Smith et al. |
| 5,142,199 | A | | 8/1992 | Elwell |
| 5,154,641 | A | | 10/1992 | McLaughlin |
| 5,161,879 | A | | 11/1992 | McDermott |
| 5,164,715 | A | | 11/1992 | Kashiwabara et al. |
| 5,184,114 | A | | 2/1993 | Brown |
| 5,194,854 | A | | 3/1993 | Havel |
| 5,209,560 | A | | 5/1993 | Taylor et al. |
| 5,225,765 | A | | 7/1993 | Callahan et al. |
| 5,226,723 | A | | 7/1993 | Chen |
| 5,254,910 | A | | 10/1993 | Yang |
| 5,256,948 | A | | 10/1993 | Boldin et al. |
| 5,278,542 | A | | 1/1994 | Smith et al. |
| 5,282,121 | A | | 1/1994 | Bornhorst et al. |
| 5,283,517 | A | | 2/1994 | Havel |
| 5,287,352 | A | | 2/1994 | Jackson et al. |
| 5,294,865 | A | | 3/1994 | Haraden |
| 5,298,871 | A | | 3/1994 | Shimohara |
| 5,301,090 | A | * | 4/1994 | Hed ..... 362/558 |
| 5,307,295 | A | | 4/1994 | Taylor et al. |
| 5,329,431 | A | | 7/1994 | Taylor et al. |
| 5,350,977 | A | | 9/1994 | Hamamoto et al. |
| 5,357,170 | A | | 10/1994 | Luchaco et al. |
| 5,371,618 | A | | 12/1994 | Tai et al. |
| 5,374,876 | A | | 12/1994 | Horibata et al. |
| 5,375,043 | A | | 12/1994 | Tokunaga |
| 5,381,074 | A | | 1/1995 | Rudzewicz et al. |
| 5,388,357 | A | | 2/1995 | Malita |
| 5,392,431 | A | | 2/1995 | Pfisterer |
| 5,402,702 | A | | 4/1995 | Hata |
| 5,404,282 | A | | 4/1995 | Klinke et al. |
| 5,406,176 | A | | 4/1995 | Sugden |
| 5,410,328 | A | | 4/1995 | Yoksza et al. |
| 5,412,284 | A | | 5/1995 | Moore et al. |
| 5,412,552 | A | | 5/1995 | Fernandes |
| 5,420,482 | A | | 5/1995 | Phares |
| 5,421,059 | A | | 6/1995 | Leffers, Jr. |
| 5,432,408 | A | | 7/1995 | Matsuda et al. |
| 5,436,535 | A | | 7/1995 | Yang |
| 5,436,853 | A | | 7/1995 | Shimohara |
| 5,450,301 | A | | 9/1995 | Waltz et al. |
| 5,461,188 | A | | 10/1995 | Drago et al. |
| 5,463,280 | A | | 10/1995 | Johnson |
| 5,465,144 | A | | 11/1995 | Parker et al. |
| 5,475,300 | A | | 12/1995 | Havel |
| 5,489,827 | A | | 2/1996 | Xia |
| 5,491,402 | A | | 2/1996 | Small |
| 5,493,183 | A | | 2/1996 | Kimball |
| 5,504,395 | A | | 4/1996 | Johnson et al. |
| 5,519,496 | A | | 5/1996 | Borgert et al. |

| | | | | |
|---|---|---|---|---|
| 5,545,950 | A | | 8/1996 | Cho |
| 5,559,681 | A | | 9/1996 | Duarte |
| 5,561,346 | A | | 10/1996 | Byrne |
| 5,575,459 | A | | 11/1996 | Anderson |
| 5,575,554 | A | | 11/1996 | Guritz |
| 5,592,051 | A | | 1/1997 | Korkala |
| 5,614,788 | A | | 3/1997 | Mullins et al. |
| 5,621,282 | A | | 4/1997 | Haskell |
| 5,621,603 | A | | 4/1997 | Adamec et al. |
| 5,633,629 | A | | 5/1997 | Hochstein |
| 5,634,711 | A | | 6/1997 | Kennedy et al. |
| 5,640,061 | A | | 6/1997 | Bornhorst et al. |
| 5,642,129 | A | | 6/1997 | Zavracky et al. |
| 5,656,935 | A | | 8/1997 | Havel |
| 5,673,059 | A | | 9/1997 | Zavracky et al. |
| 5,688,042 | A | | 11/1997 | Madadi et al. |
| 5,701,058 | A | | 12/1997 | Roth |
| 5,712,650 | A | | 1/1998 | Barlow |
| 5,721,471 | A | | 2/1998 | Begemann et al. |
| 5,734,590 | A | | 3/1998 | Tebbe |
| 5,751,118 | A | | 5/1998 | Mortimer |
| 5,752,766 | A | | 5/1998 | Bailey et al. |
| 5,769,527 | A | | 6/1998 | Taylor et al. |
| 5,784,006 | A | | 7/1998 | Hochstein |
| 5,790,329 | A | | 8/1998 | Klaus et al. |
| 5,803,579 | A | | 9/1998 | Turnbull et al. |
| 5,808,689 | A | | 9/1998 | Small |
| 5,812,105 | A | | 9/1998 | Van de Ven |
| 5,821,695 | A | | 10/1998 | Vilanilam et al. |
| 5,836,676 | A | | 11/1998 | Ando et al. |
| 5,838,247 | A | * | 11/1998 | Bladowski ..... 340/815.45 |
| 5,848,837 | A | | 12/1998 | Gustafson |
| 5,850,126 | A | | 12/1998 | Kanbar |
| 5,851,063 | A | | 12/1998 | Doughty et al. |
| 5,852,658 | A | | 12/1998 | Knight et al. |
| 5,854,542 | A | | 12/1998 | Forbes |
| RE36,030 | E | | 1/1999 | Nadeau |
| 5,859,508 | A | | 1/1999 | Ge et al. |
| 5,896,010 | A | | 4/1999 | Mikolajczak et al. |
| 5,907,742 | A | | 5/1999 | Johnson et al. |
| 5,912,653 | A | | 6/1999 | Fitch |
| 5,924,784 | A | | 7/1999 | Chliwnyj et al. |
| 5,927,845 | A | | 7/1999 | Gustafson et al. |
| 5,946,209 | A | | 8/1999 | Eckel et al. |
| 5,952,680 | A | | 9/1999 | Strite |
| 5,959,547 | A | | 9/1999 | Tubel et al. |
| 5,963,185 | A | | 10/1999 | Havel |
| 5,974,553 | A | | 10/1999 | Gandar |
| 5,980,064 | A | | 11/1999 | Metroyanis |
| 6,008,783 | A | | 12/1999 | Kitagawa et al. |
| 6,016,038 | A | | 1/2000 | Mueller et al. |
| 6,018,237 | A | | 1/2000 | Havel |
| 6,020,825 | A | | 2/2000 | Chansky et al. |
| 6,025,550 | A | | 2/2000 | Kato |
| 6,031,343 | A | | 2/2000 | Recknagel et al. |
| 6,068,383 | A | | 5/2000 | Robertson et al. |
| 6,069,597 | A | | 5/2000 | Hansen |
| 6,072,280 | A | | 6/2000 | Allen |
| 6,092,915 | A | | 7/2000 | Rensch |
| 6,095,661 | A | | 8/2000 | Lebens et al. |
| 6,097,352 | A | | 8/2000 | Zavracky et al. |
| 6,127,783 | A | | 10/2000 | Pashley et al. |
| 6,132,072 | A | | 10/2000 | Turnbull et al. |
| 6,135,604 | A | | 10/2000 | Lin |
| 6,150,771 | A | * | 11/2000 | Perry ..... 315/291 |
| 6,150,774 | A | | 11/2000 | Mueller et al. |
| 6,166,496 | A | | 12/2000 | Lys et al. |
| 6,175,201 | B1 | | 1/2001 | Sid |
| 6,181,126 | B1 | | 1/2001 | Havel |
| 6,183,086 | B1 | | 2/2001 | Neubert |
| 6,183,104 | B1 | | 2/2001 | Ferrara |
| 6,184,628 | B1 | | 2/2001 | Ruthenberg |
| 6,196,471 | B1 | | 3/2001 | Ruthenberg |
| 6,211,626 | B1 | | 4/2001 | Lys et al. |
| 6,215,409 | B1 | | 4/2001 | Blach |
| 6,250,774 | B1 | | 6/2001 | Begemann et al. |
| 6,252,358 | B1 | | 6/2001 | Xydis et al. |
| 6,273,338 | B1 | | 8/2001 | White |
| 6,292,901 | B1 | | 9/2001 | Lys et al. |
| 6,310,590 | B1 | | 10/2001 | Havel |
| 6,323,832 | B1 | | 11/2001 | Nishizawa et al. |
| 6,340,868 | B1 | | 1/2002 | Lys et al. |
| 6,445,139 | B1 | | 9/2002 | Marshall et al. |
| 6,448,550 | B1 | | 9/2002 | Nishimura |
| 6,459,919 | B1 | | 10/2002 | Lys et al. |
| 6,495,964 | B1 | | 12/2002 | Muthu et al. |
| 6,528,954 | B1 | | 3/2003 | Lys et al. |
| 6,548,967 | B1 | | 4/2003 | Dowling et al. |
| 6,577,080 | B2 | | 6/2003 | Lys et al. |
| 6,608,453 | B2 | | 8/2003 | Morgan et al. |
| 6,624,597 | B2 | | 9/2003 | Dowling et al. |
| 2001/0033488 | A1 | | 10/2001 | Chliwnyj et al. |
| 2002/0038157 | A1 | | 3/2002 | Dowling et al. |
| 2002/0044066 | A1 | | 4/2002 | Dowling et al. |
| 2002/0047569 | A1 | | 4/2002 | Dowling et al. |
| 2002/0047624 | A1 | | 4/2002 | Stam et al. |
| 2002/0048169 | A1 | | 4/2002 | Dowling et al. |
| 2002/0057061 | A1 | | 5/2002 | Mueller et al. |
| 2002/0070688 | A1 | | 6/2002 | Dowling et al. |
| 2002/0074559 | A1 | | 6/2002 | Dowling et al. |
| 2002/0078221 | A1 | | 6/2002 | Blackwell et al. |
| 2002/0101197 | A1 | | 8/2002 | Lys et al. |
| 2002/0130627 | A1 | | 9/2002 | Morgan et al. |
| 2002/0145394 | A1 | | 10/2002 | Morgan et al. |
| 2002/0145869 | A1 | | 10/2002 | Dowling |
| 2002/0152045 | A1 | | 10/2002 | Dowling et al. |
| 2002/0153851 | A1 | | 10/2002 | Morgan et al. |
| 2002/0158583 | A1 | | 10/2002 | Lys et al. |
| 2002/0163316 | A1 | | 11/2002 | Lys et al. |
| 2002/0171365 | A1 | | 11/2002 | Morgan et al. |
| 2002/0171377 | A1 | | 11/2002 | Mueller et al. |
| 2002/0171378 | A1 | | 11/2002 | Morgan et al. |
| 2002/0176259 | A1 | | 11/2002 | Ducharme |
| 2002/0195975 | A1 | | 12/2002 | Schanberger et al. |
| 2003/0011538 | A1 | | 1/2003 | Flamm et al. |
| 2003/0028260 | A1 | | 2/2003 | Blackwell |
| 2003/0057884 | A1 | | 3/2003 | Dowling et al. |
| 2003/0057886 | A1 | | 3/2003 | Lys et al. |
| 2003/0057887 | A1 | | 3/2003 | Dowling et al. |
| 2003/0057890 | A1 | | 3/2003 | Lys et al. |
| 2003/0076281 | A1 | | 4/2003 | Gregory et al. |
| 2003/0100837 | A1 | | 5/2003 | Lys et al. |
| 2003/0133292 | A1 | | 7/2003 | Mueller et al. |
| 2003/0137258 | A1 | | 7/2003 | Piepgras et al. |

FOREIGN PATENT DOCUMENTS

| | | | |
|---|---|---|---|
| CA | 2 178 432 | | 12/1996 |
| CA | 2134848 | | 11/1998 |
| DE | 2315709 | | 10/1974 |
| DE | 205307 | | 12/1983 |
| DE | 3438154 | A1 | 4/1986 |
| DE | 03837313 | | 5/1989 |
| DE | 03805998 | | 9/1989 |
| DE | 3925767 | A1 | 4/1990 |
| DE | 8902905 | | 5/1990 |
| DE | 3917101 | | 11/1990 |
| DE | 3916875 | | 12/1990 |

| | | | |
|---|---|---|---|
| DE | 4041338 | A1 | 7/1992 |
| DE | 4130576 | C1 | 3/1993 |
| DE | 9414688 | U1 | 2/1995 |
| DE | 9414689 | | 2/1995 |
| DE | 4419006 | A1 | 12/1995 |
| DE | 29607270 | U1 | 8/1996 |
| DE | 19525897 | | 10/1996 |
| DE | 29620583 | U1 | 3/1997 |
| DE | 19651140 | A1 | 6/1997 |
| DE | 19602891 | A1 | 7/1997 |
| DE | 19602891 | A1 | 8/1997 |
| DE | 20018865 | U1 | 3/2001 |
| EP | 482680 | A1 | 4/1992 |
| EP | 0495305 | A2 | 7/1992 |
| EP | 567280 | B1 | 10/1993 |
| EP | 0534710 | B1 | 1/1996 |
| EP | 734082 | A2 | 9/1996 |
| EP | 0752632 | A2 | 1/1997 |
| EP | 0752632 | A3 | 8/1997 |
| EP | 0823812 | A2 | 2/1998 |
| EP | 0935234 | A1 | 8/1999 |
| EP | 0942631 | A2 | 9/1999 |
| EP | 1020352 | A2 | 7/2000 |
| EP | 1113215 | A2 | 7/2001 |
| EP | 1162400 | A2 | 12/2001 |
| FR | 2 640 791 | | 6/1990 |
| FR | 88 17359 | | 12/1998 |
| GB | 2045098 | A | 10/1980 |
| GB | 2131589 | A | 11/1982 |
| GB | 2135536 | A | 8/1984 |
| GB | 2176042 | A | 12/1986 |
| GB | 2210720 | A | 6/1989 |
| JP | 2247688 | | 3/1990 |
| JP | 03045166 | | 2/1991 |
| JP | 6 43830 | | 2/1994 |
| JP | 06043830 | | 2/1994 |
| JP | 7-39120 | | 7/1995 |
| JP | 8-106264 | | 4/1996 |
| JP | 08-007611 | | 12/1996 |
| JP | 9 320766 | | 12/1997 |
| KR | 10199100098 | | 11/1991 |
| WO | WO 89/05086 | | 6/1989 |
| WO | WO 94/18809 | | 8/1994 |
| WO | WO 95/13498 | | 5/1995 |
| WO | WO 96/41098 | | 12/1996 |
| WO | 99/06759 | | 2/1999 |
| WO | WO 02/061328 | A1 | 8/2002 |

OTHER PUBLICATIONS

"DS96177 RS–485 / RS–422 Differential Bus Repeater", National Semiconductor Corporation, Feb. 1996, pp. 1–8.

"DS2003 / DA9667 / DS2004 High Current / Voltage Darlington Drivers", National Semiconductor Corporation, Dec. 1995, pp. 1–8.

"LM140A / LM140 / LM340A / LM7800C Series 3—Terminal Positive Regulators", National Semiconductor Corporation, Jan. 1995, pp. 1–14.

High End Systems, Inc., Trackspot User Manual, Aug. 1997, Excerpts (Cover, Title page, pp. ii through iii and 2–13 through 2–14).

Artistic License, AL4000 DMX512 Processors, Revisions 3.4, Jun. 2000, Excerpts (Cover, pp. 7,92 through 102).

Artistic License, Miscellaneous Drawings (3 sheets) Jan. 12, 1995.

Artistic License, Miscellaneous Documents ( 2 Sheets Feb. 1995 and Apr. 1996).

Newnes's Dictionary of Electronics, Fourth Edition, S.W. Amos, et al., Preface to First Edition, pp. 278–279.

"http://www.luminus.cx/projects/chaser", (Nov. 13, 2000), pp. 1–16.

Website Reference: Lamps & Gear Site, Announcing A New Industry Standard For Addressable Lighting control Systems, 3 pages.

Furry, Kevin and Somerville, Chuck, Affidavit, LED effects, Feb. 22, 2002, pp. 24–29.

Putman, Peter H., "The Allure of LED, " www.sromagazine.biz, Jun./Jul. 2002, pp. 47–52.

Bremer, Darlene, "LED Advancements Increase Potential," www.ecmag.com, Apr. 2002, p. 115.

Longo, Linda, "LEDS Lead the Way," Home Lighting & Accessories, Jun. 2002, pp. 226–234.

Hewlett Packard Components, "Solid State Display and Optoelectronics Designer's Catalog," pp. 30–43, Jul. 1973.

INTEC Research, TRACKSPOT, http://www.intec–research.com/trackspot.htm, pp. 1–4, Apr. 24, 2003.

SHARP, Optoelecronics Data Book, pp. 1096–1097, 1994/1995.

* cited by examiner

METHODS AND APPARATUS FOR CONTROLLING DEVICES IN A NETWORKED LIGHTING SYSTEM

CROSS-REFERENCES TO RELATED APPLICATIONS

This Patent Application claims the benefit under 35 U.S.C. §119(e) of the following U.S. Provisional Applications:

Serial No. 60/301,692, filed Jun. 28, 2001, entitled "Systems and Methods for Networking LED Lighting Systems";

Serial No. 60/328,867, filed Oct. 12, 2001, entitled "Systems and Methods for Networking LED Lighting Systems;" and Serial No. 60/341,476, filed Oct. 30, 2001, entitled "Systems and Methods for LED Lighting."

This application also claims the benefit under 35 U.S.C. §120 as a continuation-in-part (CIP) of U.S. Non-provisional application Ser. No. 09/971,367, filed Oct. 4, 2001, entitled "Multicolored LED Lighting Method and Apparatus," which is a continuation of U.S. Non-provisional application Ser. No. 09/669,121, filed Sep. 25, 2000, entitled "Multicolored LED Lighting Method and Apparatus," which is a continuation of U.S. Ser. No. 09/425,770, filed Oct. 22, 1999, now U.S. Pat. No. 6,150,774, which is a continuation of U.S. Ser. No. 08/920,156, filed Aug. 26, 1997, now U.S. Pat. No. 6,016,038.

This application also claims the benefit under 35 U.S.C. §120 as a continuation-in-part (CIP) of the following U.S. Non-provisional Applications:

Ser. No. 09/870,193, filed May 30, 2001, now U.S. Pat. No. 6,608,453 entitled "Methods and Apparatus for Controlling Devices in a Networked Lighting System;"

Ser. No. 09/215,624, filed Dec. 17, 1998, now U.S. Pat. No. 6,528,954 entitled "Smart Light Bulb;"

Ser. No. 09/213,607, filed Dec. 17, 1998, now abandoned entitled "Systems and Methods for Sensor-Responsive Illumination;"

Ser. No. 09/213,189, filed Dec. 17, 1998, now U.S. Pat. No. 6,459,919 entitled "Precision Illumination;"

Ser. No. 09/213,581, filed Dec. 17, 1998, entitled "Kinetic Illumination;"

Ser. No. 09/213,540, filed Dec. 17, 1998, entitled "Data Delivery Track;"

Ser. No. 09/333,739, filed Jun. 15, 1999, entitled "Diffuse Illumination Systems and Methods;" and Ser. No. 09/815,418, filed Mar. 22, 2001, now U.S. Pat. No. 6,577,080 entitled "Lighting Entertainment System," which is a continuation of U.S. Ser. No. 09/213,548, filed Dec. 17, 1998, now U.S. Pat. No. 6,166,496.

This application also claims the benefit under 35 U.S.C. §120 of each of the following U.S. Provisional Applications, as at least one of the above-identified U.S. Non-provisional Applications similarly is entitled to the benefit of at least one of the following Provisional Applications:

Serial No. 60/071,281, filed Dec. 17, 1997, entitled "Digitally Controlled Light Emitting Diodes Systems and Methods;"

Serial No. 60/068,792, filed Dec. 24, 1997, entitled "Multi-Color Intelligent Lighting;"

Serial No. 60/078,861, filed Mar. 20, 1998, entitled "Digital Lighting Systems;"

Serial No. 60/079,285, filed Mar. 25, 1998, entitled "System and Method for Controlled Illumination;" and Serial No. 60/090,920, filed Jun. 26, 1998, entitled "Methods for Software Driven Generation of Multiple Simultaneous High Speed Pulse Width Modulated Signals."

Each of the foregoing applications is hereby incorporated herein by reference.

FIELD OF THE INVENTION

The present invention relates to lighting systems, and more particularly, to methods and apparatus for computer-based control of various light sources that may be coupled together to form a networked lighting system.

BACKGROUND

Light emitting diodes (LEDs) are semiconductor-based light sources often employed in low-power instrumentation and appliance applications for indication purposes. LEDs conventionally are available in a variety of colors (e.g., red, green, yellow, blue, white), based on the types of materials used in their fabrication. This color variety of LEDs recently has been exploited to create novel LED-based light sources having sufficient light output for new space-illumination applications. For example, as discussed in U.S. Pat. No. 6,016,038, multiple differently colored LEDs may be combined in a lighting fixture, wherein the intensity of the LEDs of each different color is independently varied to produce a number of different hues. In one example of such an apparatus, red, green, and blue LEDs are used in combination to produce literally hundreds of different hues from a single lighting fixture. Additionally, the relative intensities of the red, green, and blue LEDs may be computer controlled, thereby providing a programmable multi-color light source. Such LED-based light sources have been employed in a variety of lighting applications in which variable color lighting effects are desired.

SUMMARY OF THE INVENTION

One embodiment of the invention is directed to a method, comprising acts of: A) transmitting data to an independently addressable controller coupled to at least one LED light source and at least one other controllable device, the data including at least one of first control information for a first control signal output by the controller to the at least one LED light source and second control information for a second control signal output by the controller to the at least one other controllable device, and B) controlling at least one of the at least one LED light source and the at least one other controllable device based on the data.

Another embodiment of the invention is directed to a method, comprising acts of: A) receiving data for a plurality of independently addressable controllers, at least one independently addressable controller of the plurality of independently addressable controllers coupled to at least one LED light source and at least one other controllable device, B) selecting at least a portion of the data corresponding to at least one of first control information for a first control signal output by the at least one independently addressable controller to the at least one LED light source and second control information for a second control signal output by the at least one independently addressable controller to the at least one other controllable device, and C) controlling at least one of the at least one LED light source and the at least one other controllable device based on the selected portion of the data.

Another embodiment of the invention is directed to a lighting system, comprising a plurality of independently addressable controllers coupled together to form a network, at least one independently addressable controller of the plurality of independently addressable controllers coupled to at least one LED light source and at least one other controllable device, and at least one processor coupled to the network and programmed to transmit data to the plurality of independently addressable controllers, the data corresponding to at least one of first control information for a first control signal output by the at least one independently addressable controller to the at least one LED light source and second control information for a second control signal output by the at least one independently addressable controller to the at least one other controllable device.

Another embodiment of the invention is directed to an apparatus for use in a lighting system including a plurality of independently addressable controllers coupled together to form a network, at least one independently addressable controller of the plurality of independently addressable controllers coupled to at least one LED light source and at least one other controllable device. The apparatus comprises at least one processor having an output to couple the at least one processor to the network, the at least one processor programmed to transmit data to the plurality of independently addressable controllers, the data corresponding to at least one of first control information for a first control signal output by the at least one independently addressable controller to the at least one LED light source and second control information for a second control signal output by the at least one independently addressable controller to the at least one other controllable device.

Another embodiment of the invention is directed to an apparatus for use in a lighting system including at least one LED light source and at least one other controllable device. The apparatus comprises at least one controller having at least first and second output ports to couple the at least one controller to at least the at least one LED light source and the at least one other controllable device, respectively, the at least one controller also having at least one data port to receive data including at least one of first control information for a first control signal output by the first output port to the at least one LED light source and second control information for a second control signal output by the second output port to the at least one other controllable device, the at least one controller constructed to control at least one of the at least one LED light source and the at least one other controllable device based on the data.

Another embodiment of the invention is directed to a method in a lighting system including at least first and second independently addressable devices coupled to form a series connection, at least one device of the independently addressable devices including at least one light source. The method comprises an act of: A) transmitting data to at least the first and second independently addressable devices, the data including control information for at least one of the first and second independently addressable devices, the data being arranged based on a relative position in the series connection of at least the first and second independently addressable devices.

Another embodiment of the invention is directed to a method in a lighting system including at least first and second independently addressable devices, at least one device of the independently addressable devices including at least one light source. The method comprises acts of: A) receiving at the first independently addressable device first data for at least the first and second independently addressable devices, B) removing at least a first data portion from the first data to form second data, the first data portion corresponding to first control information for the first independently addressable device, and C) transmitting from the first independently addressable device the second data.

Another embodiment of the invention is directed to a lighting system, comprising at least first and second independently addressable devices coupled to form a series connection, at least one device of the independently addressable devices including at least one light source, and at least one processor coupled to the first and second independently addressable devices, the at least one processor programmed to transmit data to at least the first and second independently addressable devices, the data including control information for at least one of the first and second independently addressable devices, the data arranged based on a relative position in the series connection of at least the first and second independently addressable devices.

Another embodiment of the invention is directed to an apparatus for use in a lighting system including at least first and second independently addressable devices coupled to form a series connection, at least one device of the independently addressable devices including at least one light source. The apparatus comprises at least one processor having an output to couple the at least one processor to the first and second independently addressable devices, the at least one processor programmed to transmit data to at least the first and second independently addressable devices, the data including control information for at least one of the first and second independently addressable devices, the data arranged based on a relative position in the series connection of at least the first and second independently addressable devices.

Another embodiment of the invention is directed to an apparatus for use in a lighting system including at least first and second independently controllable devices, at least one device of the independently controllable devices including at least one light source. The apparatus comprises at least one controller having at least one output port to couple the at least one controller to at least the first independently controllable device and at least one data port to receive first data for at least the first and second independently controllable devices, the at least one controller constructed to remove at least a first data portion from the first data to form second data and to transmit the second data via the at least one data port, the first data portion corresponding to first control information for at least the first independently controllable device.

Another embodiment of the invention is directed to a lighting system, comprising an LED lighting system adapted to receive a data stream through a first data port, generate at least one illumination condition based on at least a first portion of the data stream, and communicate at least a second portion of the data stream through a second data port. The lighting system also comprises a housing adapted to retain the LED lighting system and electrically associate the first and second data ports with a data connection comprising an electrical conductor with at least one discontinuous section having a first side and a second side that is electrically isolated from the first side. The housing is adapted such that the first data port is electrically associated with the first side of the discontinuous section and the second data port is electrically associated with the second side of the discontinuous section.

Another embodiment of the invention is directed to an apparatus, comprising a data recognition circuit adapted to process at least a first portion of a data stream received by the apparatus, an illumination control circuit coupled to the data recognition circuit and adapted to generate at least one illumination control signal in response to the processed first portion of the data stream, and an output circuit adapted to transmit from the apparatus at least a second portion of the data stream.

Another embodiment of the invention is directed to a method of controlling a plurality of lighting systems, comprising acts of communicating a data stream to a first lighting system of the plurality of lighting systems, receiving the data stream at the first lighting system and reading at least a first portion of the data stream, generating at least one lighting effect at the first lighting system in response to the first portion of the data stream, and communicating at least a second portion of the data stream to a second lighting system of the plurality of lighting systems.

Another embodiment of the invention is directed to an integrated circuit to control at least one illumination source, comprising a data reception circuit, an illumination control signal generation circuit coupled to the data reception circuit, and a clock generating circuit coupled to the data reception circuit. The data reception circuit is adapted to extract information from serial data input to the integrated circuit in coordination with a clock pulse generated by the clock generating circuit, and the illumination control signal generation circuit is adapted to generate at least one illumination control signal to control the at least one illumination source based on the extracted information.

Another embodiment of the invention is directed to an integrated circuit, adapted to read serial data input to the integrated circuit so as to directly control at least one LED, wherein the integrated circuit is adapted to read the serial data without the aid of an external frequency reference.

Another embodiment of the invention is directed to an integrated circuit, comprising a data reception circuit, a data transmission circuit, an illumination control signal generation circuit, and a voltage reference circuit, wherein the voltage reference circuit is adapted to regulate current provided by the illumination control generation circuit.

Another embodiment of the invention is directed to an apparatus adapted to process serial data and to control at least one LED in response to the serial data, comprising a counter circuit adapted to measure a first period between a first edge of a first polarity of the serial data and a second edge of the first polarity of the serial data. The counter circuit is further adapted to measure a second period between the first edge of the first polarity of the serial data and a first edge of a second polarity of the serial data. The counter circuit is further adapted to compare the second period with a predetermined fraction of the first period to determine if the serial data is in a first state.

Another embodiment of the invention is directed to an integrated circuit adapted to read serial data and to control at least one LED in response to the serial data, comprising a counter circuit adapted to measure a number of data transitions of the serial data within a predetermined period and determine if the data transitions represent a first data state.

Another embodiment of the invention is directed to an integrated circuit, comprising a power input pin adapted to receive external power, a ground pin adapted to connect the integrated circuit to a common reference potential, a reference pin adapted to connect to an external component to provide the integrated circuit a reference from which to regulate at least one LED, a serial data input pin for receiving serial data, a serial data output pin for transmitting serial data, and at least one switchable constant current output pin adapted to control the at least one LED.

Another embodiment of the invention is directed to a method of processing serial data to control at least one LED in response to the serial data, comprising acts of: (A) measuring a number of data transitions of the serial data within a predetermined period; and (B) determining if the data transitions represent a first data state based on the act (A).

DETAILED DESCRIPTION

Figure 1:
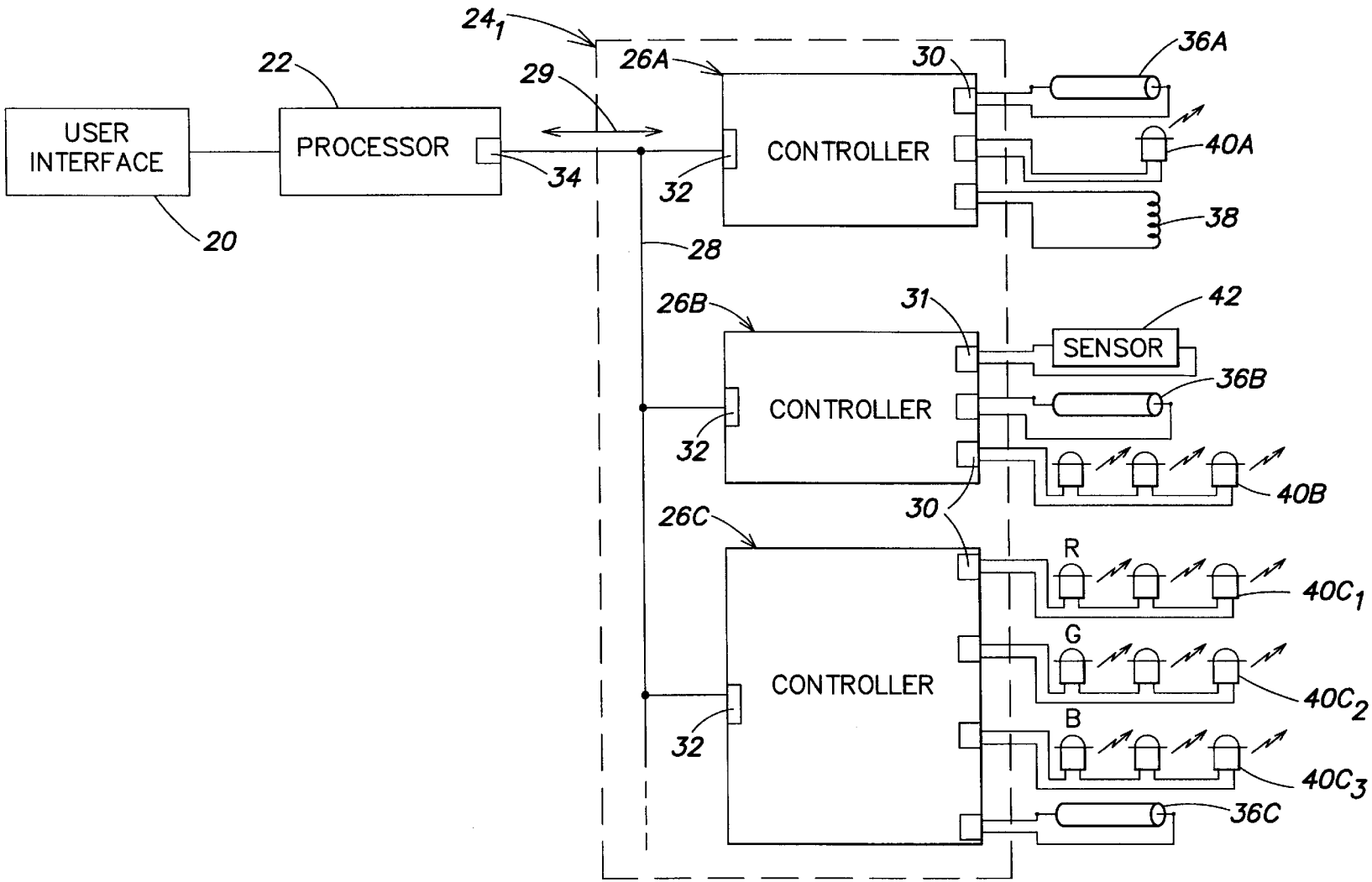
FIG. 1 is a diagram showing a networked lighting system according to one embodiment of the invention.

The present invention is directed generally to networked lighting systems, and to various methods and apparatus for computer-based control of various light sources and other devices that may be coupled together to form a networked lighting system.

For example, in one embodiment, a plurality of LED-based lighting systems are arranged as computer controllable "light strings." Applications contemplated for such light strings include, but are not limited to, decorative and entertainment-oriented lighting applications (e.g., Christmas tree lights, display lights, theme park lighting, video and other game arcade lighting, etc.). Via computer control, one or more such light strings may provide a variety of complex temporal and color-changing lighting effects. In one aspect of this embodiment, lighting data is communicated in a given light string in a serial manner, according to a variety of different data transmission and processing schemes. In another aspect, individual lighting systems of a light string are coupled together via a variety of different conduit configurations to provide for easy coupling and arrangement of multiple light sources constituting the light string. In yet another aspect, small LED-based lighting systems capable of being arranged in a light string configuration are manufactured as integrated circuits including data processing circuitry and control circuitry for LED light sources, and are packaged along with LEDs for convenient coupling to a conduit to connect multiple lighting systems.

In another embodiment of the invention, conventional light sources are employed in combination with LED-based (e.g., variable color) light sources to realize enhanced lighting effects. For example, in one embodiment, one or more computer-controllable (e.g., microprocessor-based) light sources conventionally used in various space-illumination applications and LED-based light sources are combined in a single fixture (hereinafter, a "combined" fixture), wherein the conventional light sources and the LED-based sources may be controlled independently. In another embodiment, dedicated computer-controllable light fixtures including conventional space-illumination light sources and LED-based light fixtures, as well as combined fixtures, may be distributed throughout a space and coupled together as a network to facilitate computer control of the fixtures.

In one embodiment of the invention, controllers (which may, for example, be microprocessor-based) are associated with both LED-based light sources and conventional light sources (e.g., fluorescent light sources) such that the light sources are independently controllable. More specifically, according to one embodiment, individual light sources or groups of light sources are coupled to independently controllable output ports of one or more controllers, and a number of such controllers may in turn be coupled together in various configurations to form a networked lighting system. According to one aspect of this embodiment, each controller coupled to form the networked lighting system is "independently addressable," in that it may receive data for multiple controllers coupled to the network, but selectively responds to data intended for one or more light sources coupled to it. By virtue of the independently addressable controllers, individual light sources or groups of light sources coupled to the same controller or to different controllers may be controlled independently of one another based on various control information (e.g., data) transported throughout the network. In one aspect of this embodiment, one or more other controllable devices (e.g., various actuators, such as relays, switches, motors, etc.) also may be coupled to output ports of one or more controllers and independently controlled.

According to one embodiment, a networked lighting system may be an essentially one-way system, in that data is transmitted to one or more independently addressable controllers to control various light sources and/or other devices via one or more output ports of the controllers. In another embodiment, controllers also may have one or more independently identifiable input ports to receive information (e.g., from an output of a sensor) that may be accessed via the network and used for various control purposes. In this aspect, the networked lighting system may be considered as a two-way system, in that data is both transmitted to and received from one or more independently addressable controllers. It should be appreciated, however, that depending on a given network topology (i.e., interconnection of multiple controllers) as discussed further below, according to one embodiment, a controller may both transmit and receive data on the network regardless of the particular configuration of its ports.

In sum, a lighting system controller according to one embodiment of the invention may include one or more independently controllable output ports to provide control signals to light sources or other devices, based on data received by the controller. The controller output ports are independently controllable in that each controller receiving data on a network selectively responds to and appropriately routes particular portions of the data intended for that controller's output ports. In one aspect of this embodiment, a lighting system controller also may include one or more independently identifiable input ports to receive output signals from various sensors (e.g., light sensors, sound or pressure sensors, heat sensors, motion sensors); the input ports are independently identifiable in that the information obtained from these ports may be encoded by the controller as particularly identifiable data on the network. In yet another aspect, the controller is "independently addressable," in that the controller may receive data intended for multiple controllers coupled to the network, but selectively exchanges data with (i.e., receives data from and/or transmits data to) the network based on the one or more input and/or output ports it supports.

According to one embodiment of the invention in which one or more sensors are employed, a networked lighting system may be implemented to facilitate automated computer-controlled operation of multiple light sources and devices in response to various feedback stimuli, for a variety of space-illumination applications. For example, automated lighting applications for home, office, retail environments and the like may be implemented based on a variety of feedback stimuli (e.g., changes in temperature or natural ambient lighting, sound or music, human movement or other motion, etc.).

According to various embodiments, multiple controllers may be coupled together in a number of different configurations (i.e., topologies) to form a networked lighting system. For example, according to one embodiment, data including control information for multiple light sources (and optionally other devices), as well as data corresponding to information received from one or more sensors, may be transported throughout the network between one or more central or "hub" processors, and multiple controllers each coupled to one or more light sources, other controllable devices, and/or sensors. In another embodiment, a network of multiple controllers may not include a central hub processor exchanging information with the controllers; rather, the controllers may be coupled together to exchange information with each other in a de-centralized manner.

More generally, in various embodiments, a number of different network topologies, data protocols, and addressing schemes may be employed in networked lighting systems according to the present invention. For example, according to one embodiment, one or more particular controller addresses may be manually pre-assigned to each controller on the network (e.g., stored in nonvolatile memory of the controller). Alternatively, the system may be "self-learning" in that one or more central processors (e.g., servers) may query (i.e., "ping") for the existence of controllers (e.g., clients) coupled to the network, and assign one or more addresses to controllers once their existence is verified. In these embodiments, a variety of addressing schemes and data protocols may be employed, including conventional Internet addressing schemes and data protocols.

In yet other embodiments, a particular network topology may dictate an addressing scheme and/or data protocol for the networked lighting system. For example, in one embodiment, addresses may be assigned to respective controllers on the network based on a given network topology and a particular position in the network topology of respective controllers. Similarly, in another embodiment, data may be arranged in a particular manner (e.g., a particular sequence) for transmission throughout the network based on a particular position in the network topology of respective controllers. In one aspect of this embodiment, the network may be considered "self-configuring" in that it does not require the specific assignment of addresses to controllers, as the position of controllers relative to one another in the network topology dictates the data each controller exchanges with the network.

In particular, according to one embodiment, data ports of multiple controllers are coupled to form a series connection (e.g., a daisy-chain or ring topology for the network), and data transmitted to the controllers is arranged sequentially based on a relative position in the series connection of each controller. In one aspect of this embodiment, as each controller in the series connection receives data, it "strips off" one or more initial portions of the data sequence intended for it and transmits the remainder of the data sequence to the next controller in the series connection. Each controller on the network in turn repeats this procedure, namely, stripping off one or more initial portions of a received data sequence and transmitting the remainder of the sequence. Such a network topology obviates the need for assigning one or more specific addresses to each controller; as a result, each controller may be configured similarly, and controllers may be flexibly interchanged on the network or added to the network without requiring a system operator or network administrator to reassign addresses.

Following below are more detailed descriptions of various concepts related to, and embodiments of, methods and apparatus according to the present invention for controlling devices in a networked lighting system. It should be appreciated that various aspects of the invention, as discussed above and outlined further below, may be implemented in any of numerous ways, as the invention is not limited to any particular manner of implementation. Examples of specific implementations are provided for illustrative purposes only.

FIG. 1 is a diagram illustrating a networked lighting system according to one embodiment of the invention. In the system of FIG. 1, three controllers 26A, 26B and 26C are coupled together to form a network $\mathbf{24}_1$. In particular, each of the controllers 26A, 26B and 26C has a data port 32 through which data 29 is exchanged between the controller and at least one other device coupled to the network. While FIG. 1 shows a network including three controllers, it should be appreciated that the invention is not limited in this respect, as any number of controllers may be coupled together to form the network $\mathbf{24}_1$.

FIG. 1 also shows a processor 22 coupled to the network $\mathbf{24}_1$ via an output port 34 of the processor. In one aspect of the embodiment shown in FIG. 1, the processor 22 also may be coupled to a user interface 20 to allow system operators or network administrators to access the network (e.g., transmit information to and/or receive information from one or more of the controllers 26A, 26B, and 26C, program the processor 22, etc.).

The networked lighting system shown in FIG. 1 is configured essentially using a bus topology; namely, each of the controllers is coupled to a common bus 28. However, it should be appreciated that the invention is not limited in this respect, as other types of network topologies (e.g., tree, star, daisy-chain or ring topologies) may be implemented according to other embodiments of the invention. In particular, an example of a daisy-chain or ring topology for a networked lighting system according to one embodiment of the invention is discussed further below in connection with FIG. 3. Also, it should be appreciated that the network lighting system illustrated in FIG. 1 may employ any of a variety of different addressing schemes and data protocols to transfer data 29 between the processor 22 and one or more controllers 26A, 26B, and 26C, or amongst the controllers. Some examples of addressing schemes and data protocols suitable for purposes of the present invention are discussed in greater detail below.

As also illustrated in the embodiment of FIG. 1, each controller 26A, 26B, and 26C of the networked lighting system is coupled to one or more of a variety of devices, including, but not limited to, conventional light sources (e.g., fluorescent or incandescent lights), LED-based light sources, controllable actuators (e.g., switches, relays, motors, etc.), and various sensors (e.g., light, heat, sound/pressure, motion sensors). For example, FIG. 1 shows that the controller 26A is coupled to a fluorescent light 36A, an LED 40A, and a controllable relay 38; similarly, the controller 26B is coupled to a sensor 42, a fluorescent light source 36B, and a group 40B of three LEDs, and the controller 26C is coupled to three groups $\mathbf{40}C_1$, $\mathbf{40}C_2$, and $\mathbf{40}C_3$ of LEDs, as well as a fluorescent light source 36C.

The fluorescent light sources illustrated in FIG. 1 (and in other figures) are shown schematically as simple tubes; however, it should be appreciated that this depiction is for purposes of illustration only. In particular, the gas discharge tube of a fluorescent light source typically is controlled by a ballast (not shown in the figures) which receives a control signal (e.g., a current or voltage) to operate the light source. For purposes of this disclosure, fluorescent light sources generally are understood to comprise a glass tube filled with a vapor, wherein the glass tube has an inner wall that is coated with a fluorescent material. Fluorescent light sources emit light by controlling a ballast electrically coupled to the glass tube to pass an electrical current through the vapor in the tube. The current passing through the vapor causes the vapor to discharge electrons, which in turn impinge upon the fluorescent material on the wall of the tube and cause it to glow (i.e., emit light). One example of a conventional fluorescent light ballast may be controlled by applying an AC voltage (e.g., 120 Volts AC) to the ballast to cause the glass tube to emit light. In another example of a conventional fluorescent light ballast, a DC voltage between 0 and 10 Volts DC may be applied to the ballast to incrementally control the amount of light (e.g., intensity) radiated by the glass tube.

In the embodiment of FIG. 1, it should be appreciated generally that the particular types and configuration of various devices coupled to the controllers 26A, 26B, and 26C is for purposes of illustration only, and that the invention is not limited to the particular configuration shown in FIG. 1. For example, according to other embodiments, a given controller may be associated with only one device, another controller may be associated with only output devices (e.g., one or more light sources or actuators), another controller may be associated with only input devices (e.g., one or more sensors), and another controller may be associated with any number of either input or output devices, or combinations of input and output devices. Additionally, different implementations of a networked lighting system according to the invention may include only light sources, light sources and other output devices, light sources and sensors, or any combination of light sources, other output devices, and sensors.

As shown in FIG. 1, according to one embodiment, the various devices are coupled to the controllers 26A, 26B, and 26C via a number of ports. More specifically, in addition to at least one data port 32, each controller may include one or more independently controllable output ports 30 as well as one or more independently identifiable input ports 31. According to one aspect of this embodiment, each output port 30 provides a control signal to one or more devices coupled to the output port 30, based on particular data received by the controller via the data port 32. Similarly, each input port 31 receives a signal from one or more sensors, for example, which the controller then encodes as data which may be transmitted via the data port 32 throughout the network and identified as corresponding to a signal received at a particular input port of the network.

In particular, according to one aspect of this embodiment, particular identifiers may be assigned to each output port and input port of a given controller. This may be accomplished, for example, via software or firmware at the controller (e.g., stored in the memory 48), a particular hardware configuration of the various input and/or output ports, instructions received via the network (i.e., the data port 32) from the processor 22 or one or more other controllers, or any combination of the foregoing. In another aspect of this embodiment, the controller is independently addressable in that the controller may receive data intended for multiple devices coupled to output ports of other controllers on the network, but has the capability of selecting and responding to (i.e., selectively routing) particular data to one or more of its output ports, based on the relative configuration of the ports (e.g., assignment of identifiers to ports and/or physical arrangement of ports) in the controller. Furthermore, the controller is capable of transmitting data to the network that is identifiable as corresponding to a particular input signal received at one or more of its input ports 31.

For example, in one embodiment of the invention based on the networked lighting system shown in FIG. 1, a sensor 42 responsive to some input stimulus (e.g., light, sound/pressure, temperature, motion, etc.) provides a signal to an input port 31 of the controller 26B, which may be particularly accessed (i.e., independently addressed) over the network $\mathbf{24}_1$ (e.g., by the processor 22) via the data port 32 of the controller 26B. In response to signals output by the sensor 42, the processor 22 may transmit various data throughout the network, including control information to control one or more particular light sources and/or other devices coupled to any one of the controllers 26A, 26B, and 26C; the controllers in turn each receive the data, and selectively route portions of the data to appropriate output ports to effect the desired control of particular light sources and/or other devices. In another embodiment of the invention not employing the processor 22, but instead comprising a de-centralized network of multiple controllers coupled together, any one of the controllers may function similarly to the processor 22, as discussed above, to first access input data from one or more sensors and then implement various control functions based on the input data.

From the foregoing, it should be appreciated that a networked lighting system according to one embodiment of the invention may be implemented to facilitate automated computer-controlled operation of multiple light sources and devices in response to various feedback stimuli (e.g., from one or more sensors coupled to one or more controllers of the network), for a variety of space-illumination applications. For example, automated networked lighting applications according to the invention for home, office, retail, commercial environments and the like may be implemented based on a variety of feedback stimuli (e.g., changes in temperature or natural ambient lighting, sound or music, human movement or other motion, etc.) for energy management and conservation, safety, marketing and advertisement, entertainment and environment enhancement, and a variety of other purposes.

In different embodiments based on the system of FIG. 1, various data protocols and addressing schemes may be employed in networked lighting systems according to the invention. For example, according to one embodiment, particular controller and/or controller output and input port addresses may be manually pre-assigned to each controller on the network $\mathbf{24}_1$ (e.g., stored in nonvolatile memory of the controller). Alternatively, the system may be "self-configuring" in that the processor 22 may query (i.e., "ping") for the existence of controllers coupled to the network $\mathbf{24}_1$, and assign addresses to controllers once their existence is verified. In these embodiments, a variety of addressing schemes and data protocols may be employed, including conventional Internet addressing schemes and data protocols. The foregoing concepts also may be applied to the embodiment of a networked lighting system shown in FIG. 3, discussed in greater detail below.

According to one embodiment of the invention, differently colored LEDs may be combined along with one or more conventional non-LED light sources, such as one or more fluorescent light sources, in a computer-controllable lighting fixture (e.g., a microprocessor-based lighting fixture). In one aspect of this embodiment, the different types of light sources in such a fixture may be controlled independently, either in response to some input stimulus or as a result of particularly programmed instructions, to provide a variety of enhanced lighting effects for various applications. The use of differently colored LEDs (e.g., red, green, and blue) in microprocessor-controlled LED-based light sources is discussed, for example, in U.S. Pat. No. 6,016,038, hereby incorporated herein by reference. In these LED-based light sources, generally an intensity of each LED color is independently controlled by programmable instructions so as to provide a variety of colored lighting effects. According to one embodiment of the present invention, these concepts are further extended to implement microprocessor-based control of a lighting fixture including both conventional non-LED light sources and novel LED-based light sources.

For example, as shown in FIG. 1, according to one embodiment of the invention, the controller 26C is coupled to a first group $\mathbf{40}C_1$ of red LEDs, a second group $\mathbf{40}C_2$ of green LEDs, and a third group $\mathbf{40}C_3$ of blue LEDs. Each of the first, second, and third groups of LEDs is coupled to a respective independently controllable output port 30 of the controller 26C, and accordingly may be independently controlled. Although three LEDs connected in series are shown in each illustrated group of LEDs in FIG. 1, it should be appreciated that the invention is not limited in this respect; namely, any number of light sources or LEDs may be coupled together in a series or parallel configuration and controlled by a given output port 30 of a controller, according to various embodiments. Additionally, it should be understood that a given controller may be controlling other components via one or more of its output ports to indirectly control one or more illumination sources (e.g., a string of LEDs) or other devices.

The controller 26C shown in FIG. 1 also is coupled to a fluorescent light source 36C via another independently controllable output port 30. According to one embodiment, data received and selectively routed by the controller 26C to its respective output ports includes control information corresponding to desired parameters (e.g., intensity) for each of the red LEDs $\mathbf{40}C_1$, the green LEDs $\mathbf{40}C_2$, the blue LEDs $\mathbf{40}C_3$, and the fluorescent light source 36C. In this manner, the intensity of the fluorescent light source 36C may be independently controlled by particular control information (e.g., microprocessor-based instructions), and the relative intensities of the red, green, and blue LEDs also may be independently controlled by respective particular control information (e.g., microprocessor-based instructions), to realize a variety of color enhancement effects for the fluorescent light source 36C.

Figure 2:
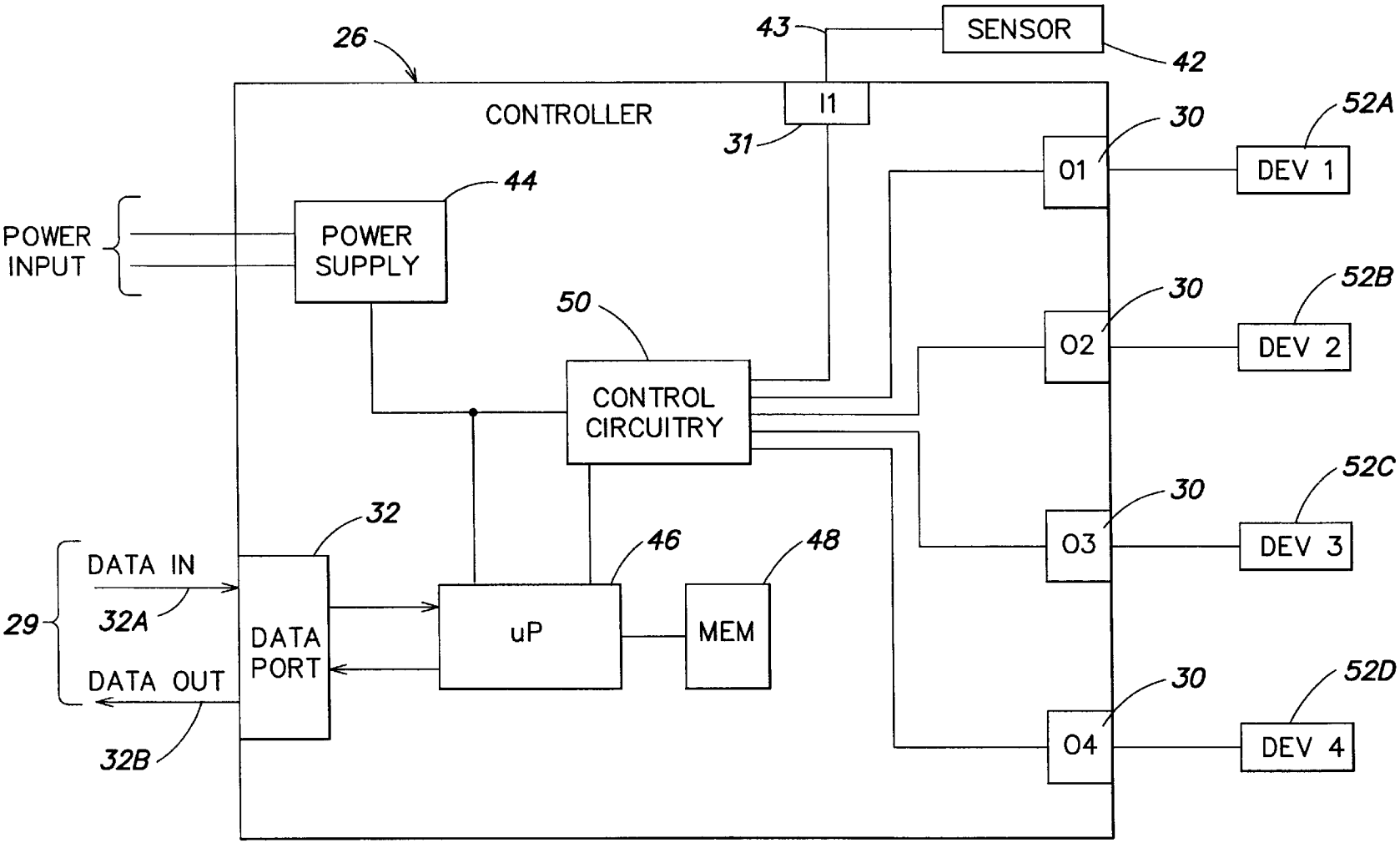
FIG. 2 is a diagram showing an example of a controller in the lighting system of FIG. 1, according to one embodiment of the invention.

FIG. 2 is a diagram illustrating an example of a controller 26, according to one embodiment of the invention, that may be employed as any one of the controllers 26A, 26B, and 26C in the networked lighting of FIG. 1. As shown in FIG. 2, the controller 26 includes a data port 32 having an input terminal 32A and an output terminal 32B, through which data 29 is transported to and from the controller 26. The controller 26 of FIG. 2 also includes a microprocessor 46 ($\mu$P) to process the data 29, and may also include a memory 48 (e.g., volatile and/or non-volatile memory).

The controller 26 of FIG. 2 also includes control circuitry 50, coupled to a power supply 44 and the microprocessor 46. The control circuitry 50 and the microprocessor 46 operate so as to appropriately transmit various control signals from one or more independently controllable output ports 30 (indicated as O1, O2, O3, and O4 in FIG. 2), based on data received by the microprocessor 46. While FIG. 2 illustrates four output ports 30, it should be appreciated that the invention is not limited in this respect, as the controller 26 may be designed to have any number of output ports. The power supply 44 provides power to the microprocessor 46 and the control circuitry 50, and ultimately may be employed to drive the control signals output by the output ports, as discussed further below.

According to one embodiment of the invention, the microprocessor 46 shown in FIG. 2 is programmed to decode or extract particular portions of the data it receives via the data port 32 that correspond to desired parameters for one or more devices 52A–52D (indicated as DEV1, DEV2, DEV3, and DEV4 in FIG. 2) coupled to one or more output ports 30 of the controller 26. As discussed above in connection with FIG. 1, the devices 52A–52D may be individual light sources, groups of lights sources, or one or more other controllable devices (e.g., various actuators). In one aspect of this embodiment, once the microprocessor 46 decodes or extracts particular portions of the received data intended for one or more output ports of the controller 26, the decoded or extracted data portions are transmitted to the control circuitry 50, which converts the data portions to control signals output by the one or more output ports.

In one embodiment, the control circuitry 50 of the controller 26 shown in FIG. 2 may include one or more digital-to-analog converters (not shown in the figure) to convert data portions received from the microprocessor 46 to analog voltage or current output signals provided by the output ports. In one aspect of this embodiment, each output port may be associated with a respective digital-to-analog converter of the control circuitry, and the control circuitry 50 may route respective data portions received from the microprocessor 46 to the appropriate digital-to-analog converters. As discussed above, the power supply 44 may provide power to the digital-to-analog converters so as to drive the analog output signals. In one aspect of this embodiment, each output port 30 may be controlled to provide a variable analog voltage control signal in a range of from 0 to 10 Volts DC. It should be appreciated, however, that the invention is not limited in this respect; namely, other types of control signals may be provided by one or more output ports of a controller, or different output ports of a controller may be configured to provide different types of control signals, according to other embodiments.

For example, according to one embodiment, the control circuitry 50 of the controller 26 shown in FIG. 2 may provide pulse width modulated signals as control signals at one or more of the output ports 30. In this embodiment, it should be appreciated that, according to various possible implementations, digital-to-analog converters as discussed above may not necessarily be employed in the control circuitry 50. The use of pulse width modulated signals to drive respective groups of differently colored LEDs in LED-based light sources is discussed for example, in U.S. Pat. No. 6,016,038, referenced above. According to one embodiment of the present invention, this concept may be extended to control other types of light sources and/or other controllable devices of a networked lighting system.

As shown in FIG. 2, the controller 26 also may include one or more independently identifiable input ports 31 coupled to the control circuitry 50 to receive a signal 43 provided by one or more sensors 42. Although the controller 26 shown in FIG. 2 includes one input port 31, it should be appreciated that the invention is not limited in this respect, as controllers according to other embodiments of the invention may be designed to have any number of individually identifiable input ports. Additionally, it should be appreciated that the signal 43 may be digital or analog in nature, as the invention is not limited in this respect. In one embodiment, the control circuitry 50 may include one or more analog-to-digital converters (not shown) to convert an analog signal received at one or more input ports 31 to a corresponding digital signal. One or more such digital signals subsequently may be processed by the microprocessor 46 and encoded as data (according to any of a variety of protocols) that may be transmitted throughout the network, wherein the encoded data is identifiable as corresponding to input signals received at one or more particular input ports 31 of the controller 26.

While the controller 26 shown in FIG. 2 includes a two-way data port 32 (i.e., having an input terminal 32A to receive data and an output terminal 32B to transmit data), as well as output ports 30 and an input port 31, it should be appreciated that the invention is not limited to the particular implementation of a controller shown in FIG. 2. For example, according to other embodiments, a controller may include a one-way data port (i.e., having only one of the input terminal 32A and the output terminal 32B and capable of either receiving or transmitting data, respectively), and/or may include only one or more output ports or only one or more input ports.

Figure 3:
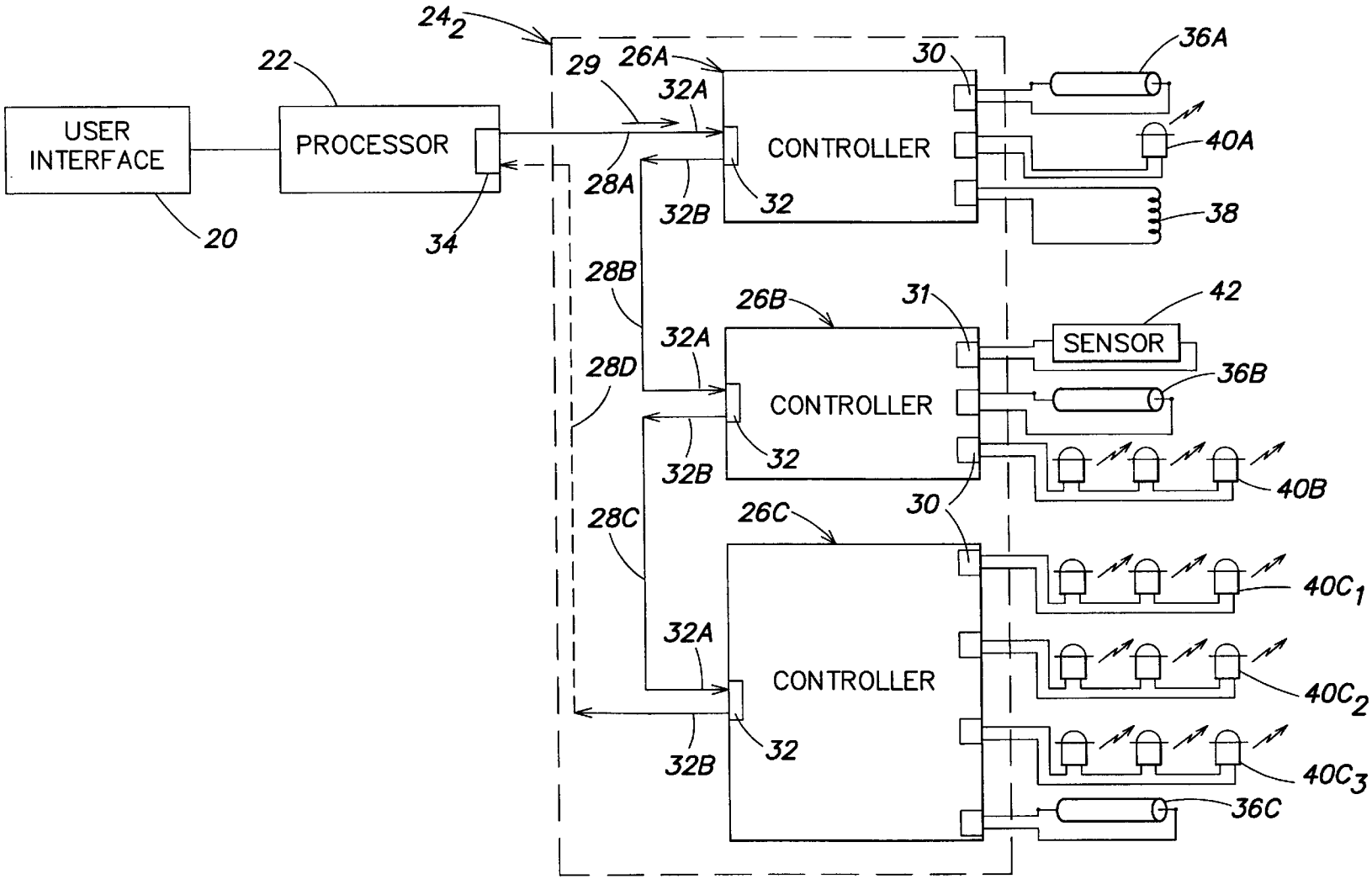
FIG. 3 is a diagram showing a networked lighting system according to another embodiment of the invention.

FIG. 3 is a diagram showing a networked lighting system according to another embodiment of the invention. In the lighting system of FIG. 3, the controllers 26A, 26B, and 26C are series-connected to form a network $\mathbf{24}_2$ having a daisy-chain or ring topology. Although three controllers are illustrated in FIG. 3, it should be appreciated that the invention according to this embodiment is not limited in this respect, as any number of controllers may be series-connected to form the network $24_2$. Additionally, as discussed above in connection with FIG. 1, networked lighting systems according to various embodiments of the invention may employ any of a number of different addressing schemes and data protocols to transport data. With respect to the networked lighting system shown in FIG. 3, in one aspect, the topology of the network $24_2$ particularly lends itself to data transport techniques based on token ring protocols. However, it should be appreciated that the lighting system of FIG. 3 is not limited in this respect, as other data transport protocols may be employed in this embodiment, as discussed further below.

In the lighting system of FIG. 3, data is transported through the network $24_2$ via a number of data links, indicated as 28A, 28B, 28C, and 28D. For example, according to one embodiment, the controller 26A receives data from the processor 22 on the link 28A and subsequently transmits data to the controller 26B on the link 28B. In turn, the controller 26B transmits data to the controller 26C on the link 28C. As shown in FIG. 3, the controller 26C may in turn optionally transmit data to the processor 22 on the link 28D, thereby forming a ring topology for the network $24_2$. However, according to another embodiment, the network topology of the system shown in FIG. 3 need not form a closed ring (as indicated by the dashed line for the data link 28D), but instead may form an open daisy-chain. For example, in an alternate embodiment based on FIG. 3, data may be transmitted to the network $24_2$ from the processor 22 (e.g., via the data link 28A), but the processor 22 need not necessarily receive any data from the network $24_2$ (e.g., there need not be any physical connection to support the data link 28D).

According to various embodiments based on the system shown in FIG. 3, the data transported on each of the data links 28A–28D may or may not be identical; i.e., stated differently, according to various embodiments, the controllers 26A, 26B, and 26C may or may not receive the same data. Additionally, as discussed above in connection with the system illustrated in FIG. 1, it should be appreciated generally that the particular types and configuration of various devices coupled to the controllers 26A, 26B, and 26C shown in FIG. 3 is for purposes of illustration only. For example, according to other embodiments, a given controller may be associated with only one device, another controller may be associated with only output devices (e.g., one or more light sources or actuators), another controller may be associated with only input devices (e.g., one or more sensors), and another controller may be associated with any number of either input or output devices, or combinations of input and output devices. Additionally, different implementations of a networked lighting system based on the topology shown in FIG. 3 may include only light sources, light sources and other output devices, light sources and sensors, or any combination of light sources, other output devices, and sensors.

Figure 4:
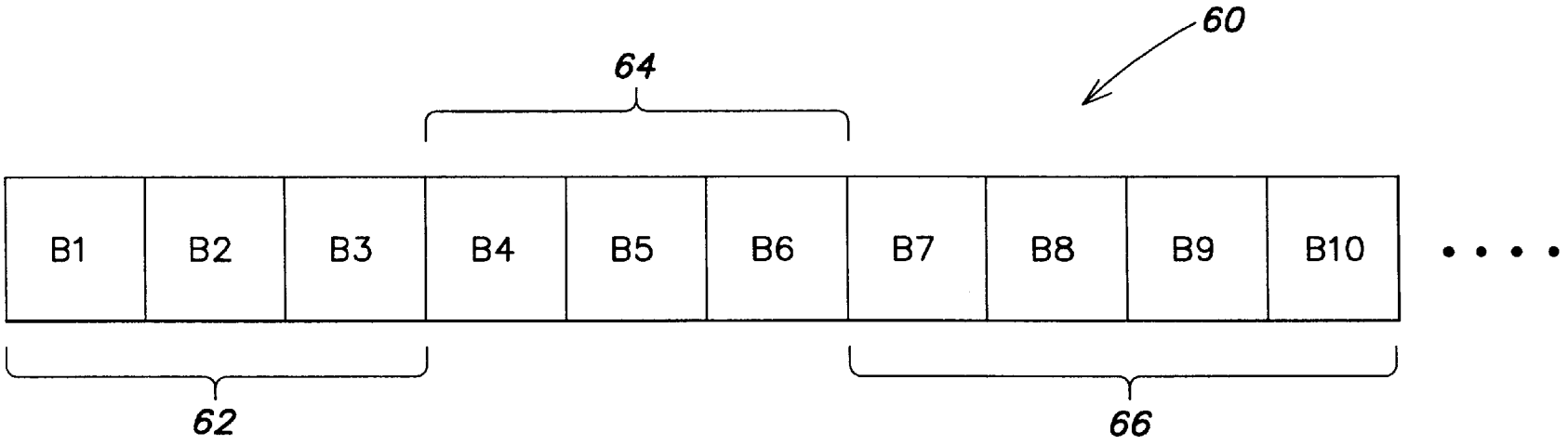
FIG. 4 is a diagram illustrating one example of a data protocol that may be used in the networked lighting system of FIG. 3, according to one embodiment of the invention.

According to one embodiment of the invention based on the network topology illustrated in FIG. 3, data transmitted from the processor 22 to the network $24_2$ (and optionally received by the processor from the network) may be particularly arranged based on the relative position of the controllers in the series connection forming the network $24_2$. For example, FIG. 4 is a diagram illustrating a data protocol based on a particular arrangement of data that may be used in the networked lighting system of FIG. 3, according to one embodiment of the invention. In FIG. 4, a sequence 60 of data bytes B1–B10 is illustrated, wherein the bytes B1–B3 constitute a first portion 62 of the sequence 60, the bytes B4–B6 constitute a second portion 64 of the sequence 60, and the bytes B7–B10 constitute a third portion 66 of the sequence 60. While FIG. 4 shows a sequence of ten data bytes arranged in three portions, it should be appreciated that the invention is not limited in this respect, and that the particular arrangement and number of data bytes shown in FIG. 4 is for purposes of illustration only.

According to one embodiment, the exemplary protocol shown in FIG. 4 may be used in the network lighting system of FIG. 3 to control various output devices (e.g., a number of light sources and/or actuators) coupled to one or more of the controllers 26A, 26B, 26C. For purposes of explaining this embodiment, the sensor 42 coupled to an input port 31 of the controller 26B shown in FIG. 3 is replaced by a light source coupled to an output port 30; namely, the controller 26B is deemed to have three independently controllable output ports 30 respectively coupled to three light sources, rather than two output ports 30 and one input port 31. In this embodiment, each of the data bytes B1–B10 shown in FIG. 4 corresponds to a digital value representing a corresponding desired parameter for a control signal provided by a particular output port of one of the controllers 26A, 26B, and 26C.

In particular, according to one embodiment of the invention employing the network topology of FIG. 3 and the data protocol shown in FIG. 4, the data sequence 60 initially is transmitted from the processor 22 to the controller 26A via the data link 28A, and the data bytes B1–B10 are particularly arranged in the sequence based on the relative position of the controllers in the series connection forming the network $24_2$. For example, the data bytes B1–B3 of the first portion 62 of the data sequence 60 respectively correspond to data intended for the three output ports 30 of the controller 26A. Similarly, the data bytes B4–B6 of the second portion 64 of the sequence respectively correspond to data intended for the three output ports 30 of the controller 26B. Likewise, the data bytes B7–B10 of the third portion 66 of the sequence respectively correspond to data intended for the four output ports 30 of the controller 26C.

In this embodiment, each controller 26A, 26B, and 26C is programmed to receive data via the input terminal 32A of the data port 32, "strip off" an initial portion of the received data based on the number of output ports supported by the controller, and then transmit the remainder of the received data, if any, via the output terminal 32B of the data port 32. Accordingly, in this embodiment, the controller 26A receives the data sequence 60 from the processor 22 via the data link 28A, strips off the first portion 62 of the three bytes B1–B3 from the sequence 60, and uses this portion of the data to control its three output ports. The controller 26A then transmits the remainder of the data sequence, including the second and third portions 64 and 66, respectively, to the controller 26B via the data link 28B. Subsequently, the controller 26B strips off the second portion 62 of the three bytes B4–B6 from the sequence (because these now constitute the initial portion of the data sequence received by the controller 26B), and uses this portion of the data to control its three output ports. The controller 26B then transmits the remainder of the data sequence (now including only the third portion 66) to the controller 26C via the data link 28C. Finally, the controller 26C strips off the third portion 66 (because this portion now constitutes the initial and only portion of the data sequence received by the controller 26C), and uses this portion of the data to control its four output ports.

While the particular configuration of the networked lighting system illustrated in FIG. 3 includes a total of ten output ports (three output ports for each of the controllers 26A and 26B, and four output ports for the controller 26C), and the data sequence 60 shown in FIG. 4 includes at least ten corresponding data bytes B1–B10, it should be appreciated that the invention is not limited in this respect; namely, as discussed above in connection with FIG. 2, a given controller may be designed to support any number of output ports. Accordingly, in one aspect of this embodiment, it should be appreciated that the number of output ports supported by each controller and the total number of controllers coupled to form the network $\mathbf{24}_2$ dictates the sequential arrangement, grouping, and total number of data bytes of the data sequence 60 shown in FIG. 4.

For example, in one embodiment, each controller is designed identically to support four output ports; accordingly, in this embodiment, a data sequence similar to that shown in FIG. 4 is partitioned into respective portions of at least four bytes each, wherein consecutive four byte portions of the data sequence are designated for consecutive controllers in the series connection. In one aspect of this embodiment, the network may be considered "self-configuring" in that it does not require the specific assignment of addresses to controllers, as the position of controllers relative to one another in the series connection dictates the data each controller responds to from the network. As a result, each controller may be configured similarly (e.g., programmed to strip off an initial four byte portion of a received data sequence), and controllers may be flexibly interchanged on the network or added to the network without requiring a system operator or network administrator to reassign addresses. In particular, a system operator or programmer need only know the relative position of a given controller in the series connection to provide appropriate data to the controller.

While embodiments herein discuss the data stream 60, of FIG. 4, as containing data segments B1, B2, etc. wherein each data segment is transmitted to an illumination system to control a particular output of a controller 26, it should be understood that the individual data segments may be read by a controller 26 and may be used to control more than one output. For example, the controller 26 may be associated with memory wherein control data is stored. Upon receipt of a data segment B1, for example, the controller may look-up and use control data from its memory that corresponds with the data segment B1 to control one or more outputs (e.g. illumination sources). For example, when a controller 26 controls two or more different colored LEDs, a received data segment B1 may be used to set the relative intensities of the different colors.

According to another embodiment of the invention based on the network topology illustrated in FIG. 3 and the data protocol shown in FIG. 4, one or more of the data bytes of the sequence 60 may correspond to digital values representing corresponding input signals received at particular input ports of one or more controllers. In one aspect of this embodiment, the data sequence 60 may be arranged to include at least one byte for each input port and output port of the controllers coupled together to form the network $\mathbf{24}_2$, wherein a particular position of one or more bytes in the sequence 60 corresponds to a particular input or output port. For example, according to one embodiment of the invention in which the sensor 42 is coupled to an input port 31 of the controller 26B as shown in FIG. 3, the byte B4 of the data sequence 60 may correspond to a digital value representing an input signal received at the input port 31 of the controller 26B.

In one aspect of this embodiment, rather than stripping off initial portions of received data as described above in the foregoing embodiment, each controller instead may be programmed to receive and transmit the entire data sequence 60. Upon receiving the entire data sequence 60, each controller also may be programmed to appropriately index into the sequence to extract the data intended for its output ports, or place data into the sequence from its input ports. In this embodiment, so as to transmit data corresponding to one or more input ports to the processor 22 for subsequent processing, the data link 28D is employed to form a closed ring topology for the network $\mathbf{24}_2$.

In one aspect of this embodiment employing a closed ring topology, the processor 22 may be programmed to initially transmit a data sequence 60 to the controller 26A having "blank" bytes (e.g., null data) in positions corresponding to one or more input ports of one or more controllers of the network $\mathbf{24}_2$. As the data sequence 60 travels through the network, each controller may place data corresponding to its input ports, if any, appropriately in the sequence. Upon receiving the data sequence via the data link 28D, the processor 22 may be programmed to extract any data corresponding to input ports by similarly indexing appropriately into the sequence.

According to one embodiment of the invention, the data protocol shown in FIG. 4 may be based at least in part on the DMX data protocol. The DMX data protocol is discussed, for example, in U.S. Pat. No. 6,016,038, referenced above. Essentially, in the DMX protocol, each byte B1–B10 of the data sequence 60 shown in FIG. 4 corresponds to a digital value in a range of 0–255. As discussed above, this digital value may represent a desired output value for a control signal provided by a particular output port of a controller; for example, the digital value may represent an analog voltage level provided by an output port, or a pulse-width of a pulse width modulated signal provided by an output port. Similarly, this digital value may represent some parameter (e.g., a voltage or current value, or a pulse-width) of a signal received at a particular input port of a controller.

According to yet another embodiment of the invention based on the network topology illustrated in FIG. 3 and the data protocol shown in FIG. 4, one or more of the data bytes of the sequence 60 may correspond to an assigned address (or group of addresses) for one or more of the controllers 26A, 26B, and 26C. For example, the byte B1 may correspond to an address (or starting address of a range of addresses) for the controller 26A, the byte B2 may correspond to an address (or starting address of a range of addresses) for the controller 26B, and the byte B3 may correspond to an address (or starting address of a range of addresses) for the controller 26C. The other bytes of the data sequence 60 shown in FIG. 4 respectively may correspond to addresses for other controllers, or may be unused bytes.

In one aspect of this embodiment, the processor 22 transmits at least the bytes B1–B3 to the controller 26A. The controller 26A stores the first byte B1 (e.g., in its memory 48, as shown in FIG. 2) as an address, removes B1 from the data sequence, and transmits the remaining bytes to the controller 26B. In a similar manner, the controller 26B receives the remaining bytes B2 and B3, stores the first received byte (i.e., B2) as an address, and transmits the remaining byte B3 to the controller 26C, which in turn stores the byte B3 (the first received byte) as an address. Hence, in this embodiment, the relative position of each controller in the series connection forming the network $\mathbf{24}_2$ dictates the address (or starting address of a range of addresses) assigned to the controller initially by the processor, rather than the data itself to be processed by the controller.

In this embodiment, as in one aspect of the system of FIG. 1 discussed above, once each controller is assigned a particular address or range of addresses, each controller may be programmed to receive and re-transmit all of the data initially transmitted by the processor 22 on the data link 28A; stated differently, in one aspect of this embodiment, once each controller is assigned an address, the sequence of data transmitted by the processor 22 is not constrained by the particular topology (i.e., position in the series connection) of the controllers that form the network $\mathbf{24}_2$. Additionally, each controller does not need to be programmed to appropriately index into a data sequence to extract data from, or place data into, the sequence. Rather, data corresponding to particular input and output ports of one or more controllers may be formatted with an "address header" that specifies a particular controller, and a particular input or output port of the controller.

According to another aspect of this embodiment, during the assignment of addresses to controllers, the processor 22 may transmit a data sequence having an arbitrary predetermined number of data bytes corresponding to controller addresses to be assigned. As discussed above, each controller in the series connection in turn extracts an address from the sequence and passes on the remainder of the sequence. Once the last controller in the series connection extracts an address, any remaining addresses in the sequence may be returned to the processor 22 via the data link 28D. In this manner, based on the number of bytes in the sequence originally transmitted by the processor 22 and the number of bytes in the sequence ultimately received back by the processor, the processor may determine the number of controllers that are physically coupled together to form the network $\mathbf{24}_2$.

According to yet another aspect of this embodiment, during the assignment of addresses to controllers, the processor 22 shown in FIG. 3 may transmit an initial controller address to the controller 26A, using one or more bytes of the data sequence 60 shown in FIG. 4. Upon receiving this initial controller address, the controller 26A may store this address (e.g., in nonvolatile memory), increment the address, and transmit the incremented address to the controller 26B. The controller 26B in turn repeats this procedure; namely, storing the received address, incrementing the received address, and transmitting the incremented address to the next controller in the series connection (i.e., the controller 26C). According to one embodiment, the last controller in the series connection (e.g., the controller 26C in the example shown in FIG. 3) transmits either the address it stored or an address that is incremented from the one it stored to the processor 22 (e.g., via the data link 28D in FIG. 3). In this manner, the processor 22 need only transmit to the network an initial controller address, and based on the address it receives back from the network, the processor may determine the number of controllers that are physically coupled together to form the network $\mathbf{24}_2$.

In the various embodiments of the invention discussed above, the processor 22 and the controllers (e.g., 26, 26A, 26B, etc.) can be implemented in numerous ways, such as with dedicated hardware, or using one or more microprocessors that are programmed using software (e.g., microcode) to perform the various functions discussed above. In this respect, it should be appreciated that one implementation of the present invention comprises one or more computer readable media (e.g., volatile and nonvolatile computer memory such as PROMs, EPROMs, and EEPROMs, floppy disks, compact disks, optical disks, magnetic tape, etc.) encoded with one or more computer programs that, when executed on one or more processors and/or controllers, perform at least some of the above-discussed functions of the present invention. The one or more computer readable media may be fixed within a processor or controller or may be transportable, such that the one or more programs stored thereon can be loaded into a processor or controller so as to implement various aspects of the present invention discussed above. The term "computer program" is used herein in a generic sense to refer to any type of computer code (e.g., software or microcode) that can be employed to program one or more microprocessors so as to implement the above-discussed aspects of the present invention.

Another embodiment of the present invention is directed to a lighting network including a plurality of lighting systems arranged in a serial configuration and associated with a processor that communicates a lighting control data stream to the plurality of lighting systems. One example of such a lighting system according to this embodiment may be given by the controller 26 shown in FIG. 2, together with one or more illumination devices coupled to the outputs of the controller. A number of such lighting systems arranged as shown in FIG. 3 provides one example of such a lighting network having a serial configuration, but it should be appreciated that this example is for purposes of illustration only, and that the invention is not limited to this particular implementation.

In a such a serial configuration, each of the plurality of lighting systems may in turn strip, or otherwise modify, the control data stream for its use and then communicate the remainder of the data stream to the remaining lighting systems in the serial configuration. In one aspect of this embodiment, the stripping or modification occurs when a lighting system receives a control data stream. In another aspect, the lighting system may strip off, or modify, a first section of the control data stream such that the lighting system can change the lighting conditions to correspond to the data. The lighting system may then take the remaining data stream and communicate it to the next lighting system in the serial configuration. In turn, this next lighting system completes similar stripping/modification, executing and re-transmitting.

Figure 5:
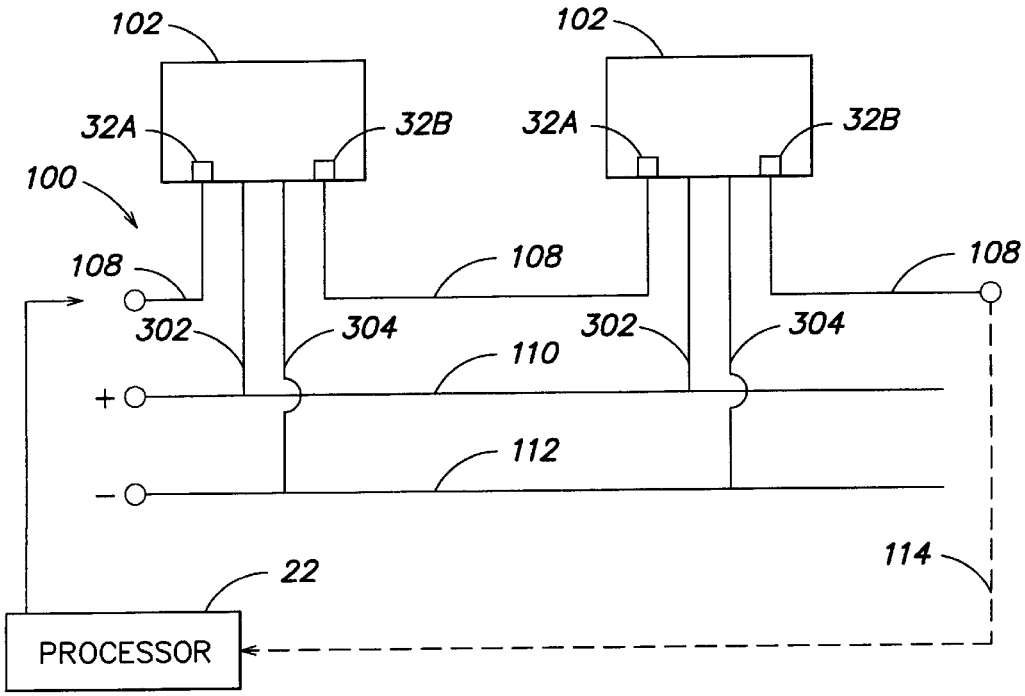
FIG. 5 illustrates a lighting network in the form of a light string, according to one embodiment of the invention.

FIG. 5 illustrates a lighting string 100 according to one embodiment of the present invention. The string 100 of FIG. 5 includes a processor 22 that communicates with a plurality of lighting systems 102. Each lighting system 102 includes a first data port 32A and a second data port 32B. The plurality of lighting systems 102 are connected in a serial fashion such that the second data port 32B from a first lighting system 102 is connected to a first data port 32A of a second lighting system.

In the embodiment of FIG. 5, the processor 22 communicates a data stream to each of the plurality of lighting systems 102 through the serial connection. The data stream may be broken into a plurality of data segments wherein each data segment is sequentially arranged to correspond with an intended lighting system in the serial connection. When the data stream is communicated to the first lighting system 102 in the serial connection, the first lighting system may strip the first data segment from the data stream and then communicate the remaining data stream to the next lighting system 102 in the serial connection. The data segments in the data stream may be broken up through any data formatting that is appropriate. It should be appreciated that there are many methods of data arrangement and data stripping contemplated by the present invention such as the first lighting system stripping the last data segment or some other predetermined segment out of the data stream, and the invention is not limited to a particular implementation.

FIG. 5 also illustrates power 110 and ground 112 connections to each of the plurality of lighting systems 102. While FIG. 5 illustrates a parallel connection of power, it should be understood that a system according to the present invention may include serial power distribution. For example, in one embodiment, a serial power distribution may include shunt voltage regulators in the lighting systems 102 to distribute the power from a constant current source. Although the line 110 is referred to generally as ground, it should be understood that this may refer to a common reference potential and may not be earth ground.

Figure 6:
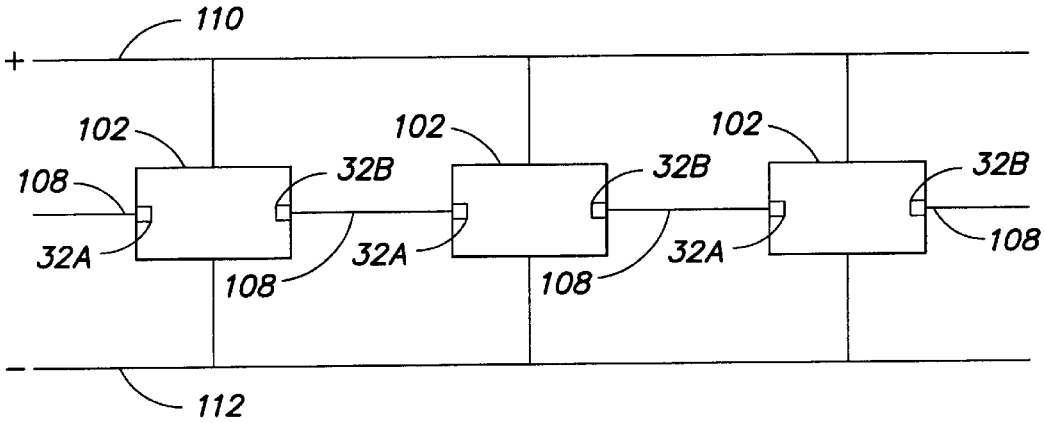
FIG. 6 illustrates one arrangement for the light string of FIG. 5, according to one embodiment of the invention.
Figure 7:
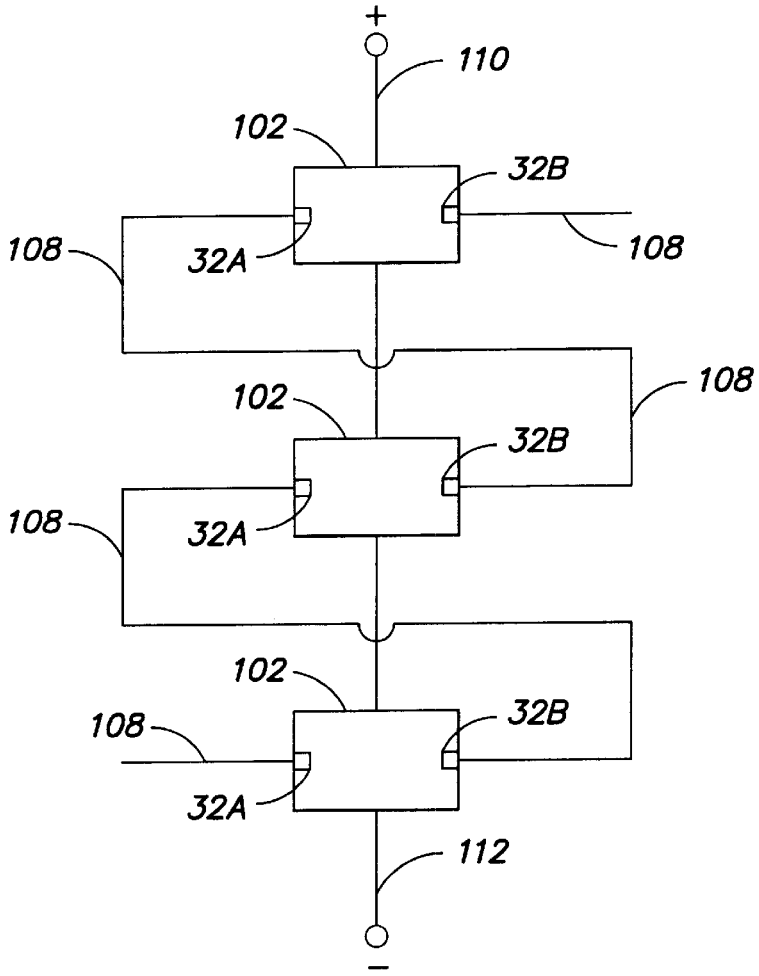
FIG. 7 illustrates another arrangement for the light string of FIG. 5, according to another embodiment of the invention.

FIGS. 6 and 7 illustrate lighting strings according to various embodiments of the present invention. The embodiment in FIG. 6 illustrates a parallel power distribution scheme with serial data lines 108. The embodiment in FIG. 7 shows a series power distribution with serial data lines 108. The illustration in FIG. 7 shows the data line passing from the second data port 32B of the first lighting system 102 to the first data port 32A of the second lighting system in the line. It should be understood that the data lines may be directed from second data port 32B of the first lighting system to second data port 32B of the second lighting system and then from the first data port 32A of the second system to the first data port 32A on the next system or any other arrangement to serially communicate the data.

Referring again to FIG. 5, in one embodiment, the lighting network 100 may include a return data line 114 that takes the data stream from the last lighting system 102 in the serial connection and communicates the remaining data stream back to the processor 22. In one aspect of this embodiment, the processor 22 may calculate the number of lighting systems in the lighting network after receiving the data on the return data line. For example, in one embodiment, the processor 22 may calculate the total number of lighting systems by comparing the number of data segments in the returned data stream to the original number of data segments initially transmitted by the processor to the first lighting system in the serial connection. In another embodiment, the processor 22 may read a portion of the returned data stream (e.g. a header or other modified portion of the data stream) and interpret the number of lighting systems from this portion. It should be appreciated that the foregoing examples are for purposes of illustration only, and that the invention is not limited to any particular implementation for determining the number of lighting systems of the light string 100.

For example, in one embodiment, the return line 114 may be used to communicate with the lighting systems 22 beginning with the last such system in the serial connection. In another embodiment, the processor may determine the number of lighting systems 102 in the serial connection and then communicate a data stream or a portion of a data stream to the first lighting system 102 through first data port 32A and communicate a data stream or portion of a data stream through the second data port 32B of the last lighting system 102 in the serial connection. The data streams communicated to the first and to the last systems 102 may be identical with the exception of the order of the data, for example.

In one aspect of this embodiment, the data stream may be identical and the lighting systems 102 may be configured to strip the last data segment from a data stream when the data stream is communicated through its second data port and strip the first data segment from the data stream when the data stream is communicated through its first data port. The method of communicating data through both ends of the lighting system string may be useful for minimizing the effect of a failed lighting system 102 in the serial connection of lighting systems 102. For example, if a third lighting system 102 in the serial connection fails and data is only communicated through a first system 102, the data transmission may stop at the third system 102. If a data stream is communicated through both ends of the lighting system string, all but the third lighting system 102 could operate.

Although many of the embodiments described herein disclose stripping data from a data stream, it should be understood that there are many methods of performing the function described and the embodiments should not be interpreted as limiting in anyway. For example, in an embodiment, rather than stripping data from a data stream, a lighting system 102 may modify data it receives such that the next lighting system 102 in the serial connection does not respond to the modified data and instead may respond to the first data in the stream that has not been modified. A person with ordinary skill in the art would appreciate that there are many methods of modifying a data stream to accomplish this function.

In yet another embodiment, the lighting systems 102 in a serial connection as described herein in connection with FIGS. 5–7 may receive data that identifies each lighting system 102 with a unique address within the serial connection and each lighting system 102 may then read the portion of a data stream that pertains to it. For example, the processor 22 may communicate a configuration data stream containing address data to a serial connection of lighting systems 102. Each of the lighting systems may receive, strip and store the first data segment within the data stream as its address. In one aspect, the address may be stored in non-volatile memory or the like such that the lighting system 102 retains the address following a power cycle. In another aspect, the address may be stored in memory and a configuration data stream may be re-communicated upon a power cycle or at another time. In yet another aspect, an addressed lighting system 102 may read addressed information from a data stream. In yet another aspect, an addressed lighting system 102 may read information from a location within a data stream. One with ordinary skill in the art would appreciate that there are many methods of communicating data to a lighting system 102 that includes an address.

Figure 8:
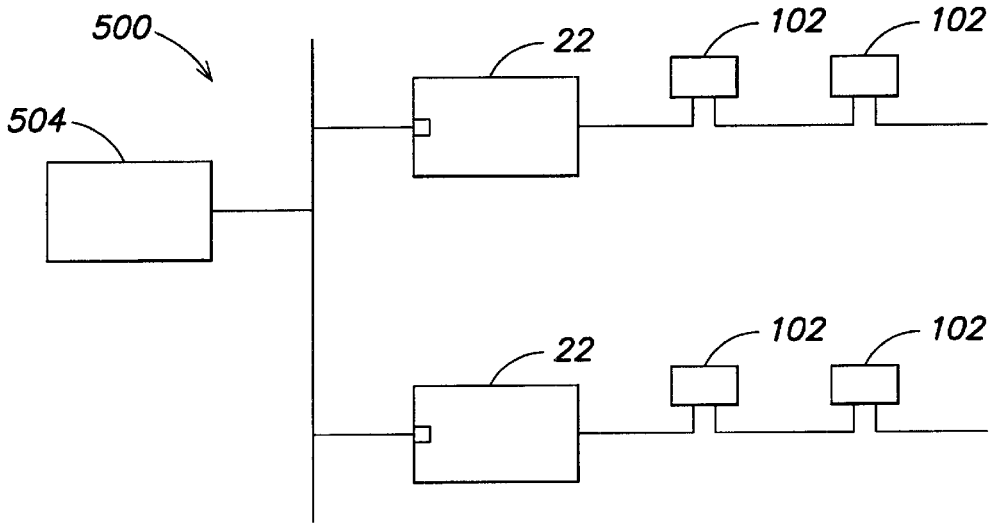
FIG. 8 illustrates a network of multiple light strings, according to another embodiment of the invention.

As discussed above in connection with FIG. 3, the lighting controllers 26 of a lighting network may receive data from one or more processors 22. In one embodiment, as illustrated in FIG. 8, such processor(s) 22 in turn ay receive higher level lighting commands and the processor(s) may generate and communicate lighting control signals based on the higher level commands. A system according to the present invention may comprise many lighting systems wherein coordinated lighting effects are generated such as, on a Ferris Wheel, amusement park ride, boardwalk, building, corridor, any other area where many lighting systems are desired.

In particular, FIG. 8 illustrates a lighting network 500 according to one embodiment of the invention, including a central processor 504 that communicates higher-level commands to a plurality of processors 22. The processors 22 may generate lighting control signals in response to the higher-level commands and communicate the lighting control signals to a plurality of lighting systems 102 as described herein. Upon receipt of the lighting control signals, the lighting systems 102 may generate LED control signals (e.g. pulse width modulated control signals). According to one aspect of this embodiment, various computations may be distributed throughout the processors 22 of the network to reduce the required bandwidth of the network and or increase the rate at which the lighting effects can be changed in the network. For example, the central processor 504 may communicate addressed commands to each of the processors 22, and each of the processors 22 in turn may have an address such that the processor 22 reads information pertaining to it from the network data.

In another aspect of the embodiment of FIG. 8, a given lighting system 102 may have an alterable address such that the address of the lighting system can be changed. The central processor 504 may, for example, generate network signals instructing a first processor 22 to generate a lighting effect that chases from its first lighting system 102 to its last lighting system 102 and instruct a second processor 22 to generate a lighting effect that chases from its last lighting system to its first lighting system. Each processor 22 may control one hundred lighting systems 102, for example, and a network may include twenty controllers 22, for example, comprising a total of 2,000 lighting systems. In various applications, such a network of lighting systems may be used to light an amusement park ride, boardwalk, building exterior, building interior, corridor, cove, walkway, pathway, tree, Christmas tree, as part of a game, such as a video game, jukebox, gambling machine, slot machine, pinball machine or other area or object where such lighting would be useful or desirable. The spokes of a Ferris Wheel may be lit using such a lighting network to generate radially propagating lighting effects, circular effects, explosion effects or any other lighting effect. The central processor 504 may also be associated with another controller, user interface, sensor, transducer or other system to initiate or generate lighting effects.

With respect to the particular functions performed by a given lighting system 102, according to other embodiments discussed in greater detail below, a lighting system 102 may receive asynchronous serial data pursuant to RS-232 protocol, for example, generates one or more PWM signals based on the asynchronous serial data to control the LEDs, and transmit modified RS-232 data to the next lighting system 102 in the chain. Such a lighting system 102 may also contain a bitstream recovery circuit, generally known as a Universal Asynchronous Receiver Transmitter (UART), or may perform bitstream recovery through software or other techniques. Lighting device 102 may be associated with a clock source which, for example, may be controlled by a resonator of some kind (crystal, ceramic, saw, LC, RC or other). In one aspect, the clock source could be tuned through measurement of certain features, such as pulse widths contained in the bitstream, to increase clock accuracy, or decrease cost of the frequency source.

In another embodiment, a given lighting system 102 may receive data coded with a code, wherein pulses of less than ½ of a pulse period correspond to a first logical state, while pulses of more than ½ of a pulse period correspond to a second logical state. System 102 may then compare the lengths of incoming pulse width with some fraction of the pulse period to determine if the transmitted bit was of the first or second logical state. At least one advantage of this type of bit stream over RS-232, or other protocols, is that system 102 may utilize an internal un-calibrated frequency reference, and a set of counters, registers, and logic gates to extract the data. Additional counters, registers and logic can be utilized to generate the output data stream, and to create drive signals for the LEDs. Another advantage of this system is that it may be integrated onto a very small, very easy to manufacture custom integrated circuit.

It should be appreciated that a variety of coding or modulation methods are possible and are encompassed by the present invention. A person with ordinary skill in the art would also understand that an unlimited number of methods for encoding (modulating) and decoding (demodulating) signals that conform to those coding methods are possible and are encompassed by the present invention.

Figure 9:
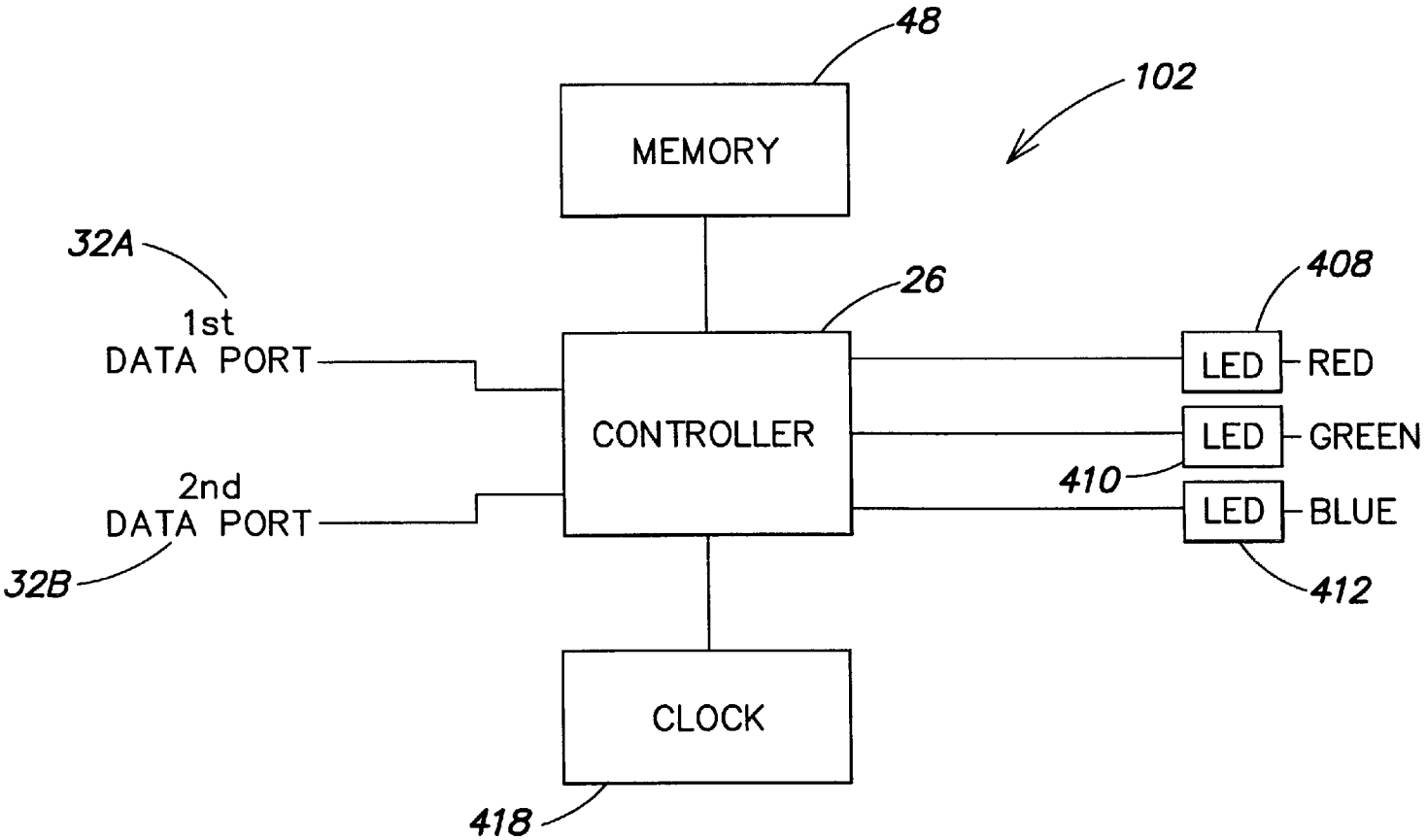
FIG. 9 illustrates an example of a lighting system of the light string of FIGS. 5–8, according to one embodiment of the invention.

As discussed above, in another embodiment, as shown for example in FIG. 9, a lighting system 102 may include a controller 26 (as discussed earlier in connection with other figures) to perform various data processing and lighting control functions discussed herein. The controller may be connected to a voltage regulator (not shown), a first data port 32A, a second data port 32B, and three light sources 408, 410, and 412 each having one or more LEDs. The LEDs may be associated with current limiting resistors (not shown), which may also be connected to the voltage regulator. A clock source 418 may also be associated with the controller. The controller may convert an incoming data stream to a series of binary words. For example, words beginning with a zero bit may signify start of frame to the program, and are also transmitted on the second data port 32B. Subsequent words beginning with a one bit may be loaded into PWM registers of the controller to drive the LEDs, and a different word beginning with a 0 bit may be transmitted to the second data port 32B. When the required number of words has been loaded into the registers, additionally received words may be transmitted to the second data port. In this arrangement, each system 102 extracts data intended for it, and creates a data stream suitable for the next system 102.

Figure 10A:
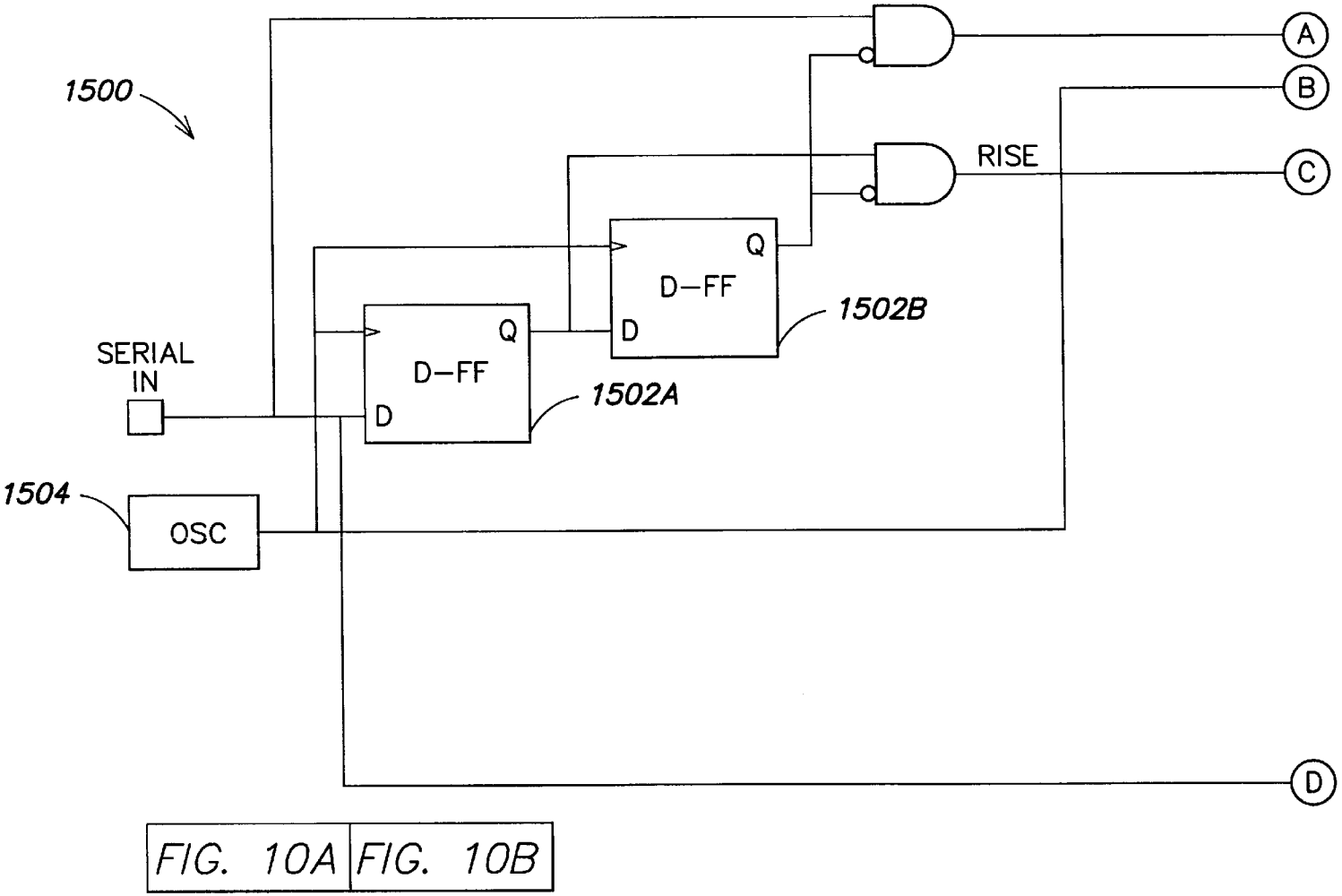
FIGS. 10A and 10B illustrate a bit extracting circuitry of a lighting system, according to one embodiment of the invention.
Figure 10B:
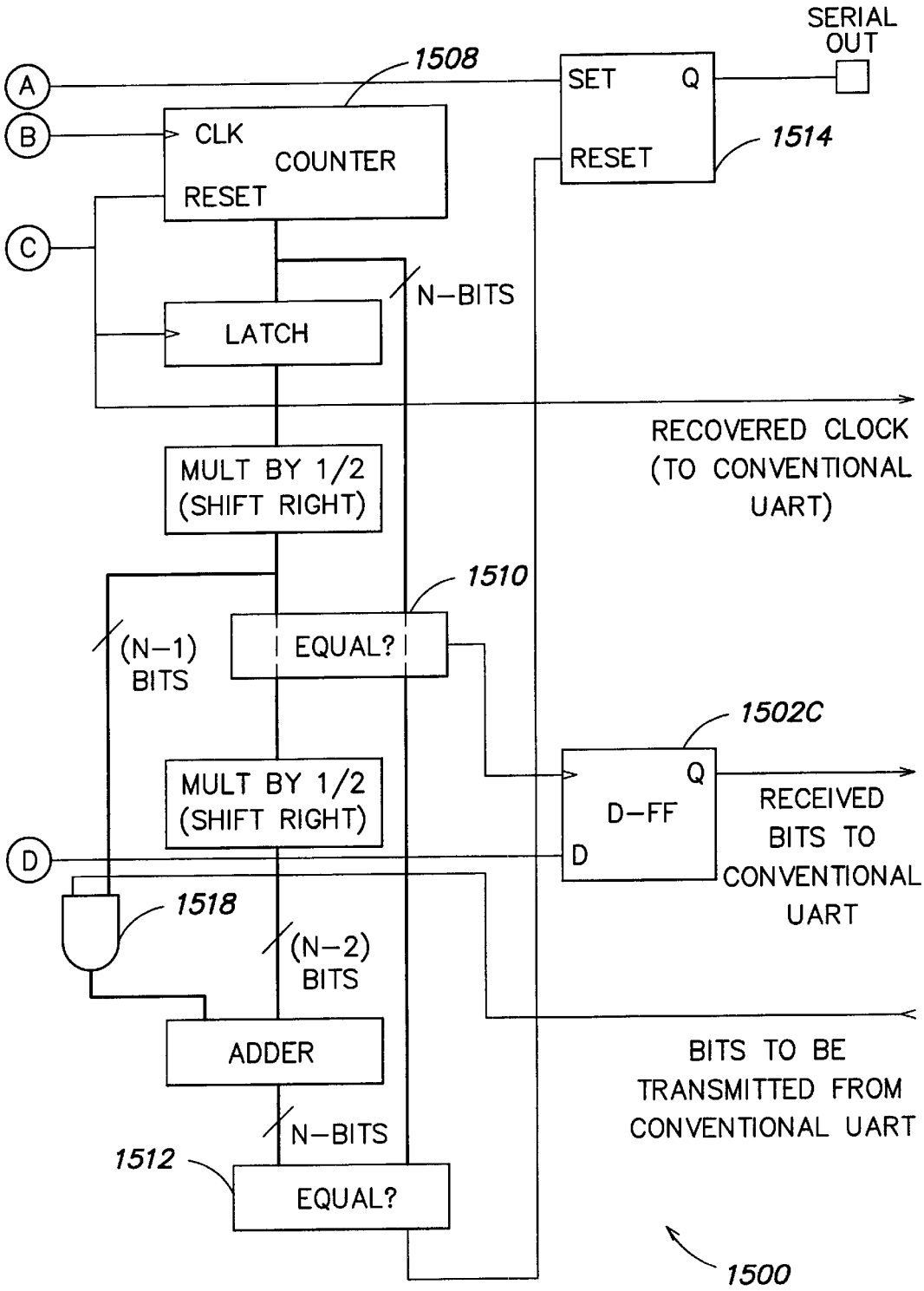

In yet another embodiment as illustrated in FIG. 10, a bit extractor 1500 may be employed in various implementations of a controller 26 according to the principles of the present invention. As shown in FIG. 10, the bit extractor 1500 may comprise a rising edge signal detector including two D-type flip flops 1502A and 1502B and a NAND gate. A stable non-precision oscillator 1504 may be used as the clock source to the rising edge signal detector, and an N-bit counter 1508. The RISE signal indicated in FIG. 10 is utilized to sequentially latch the state of, and reset the counter 1508. The latched value is the period, in clock pulses, of the incoming serial stream. Half way through the subsequent period, an equality detector 1510 reports true, triggering the flip flop 1502C to sample the state of the input serial stream, hence providing latched, recovered bits. The recovered bits may then be presented to a conventional UART or shift register, along with the recovered clock (the RISE signal) to recover the M-bit data words. So long as the data input period remains fairly constant, the input bits are recovered. This occurs regardless of the frequency of the oscillator, so long as the data input period is chosen to be less than approximately ⅙th of the oscillator frequency, and greater than the overflow period of the counter. It should be appreciated by those skilled in the art, that both very high oscillator frequencies and counters with large numbers of bits (N) may be used to achieve arbitrarily wide ranges of input serial stream frequencies. In a preferred embodiment, N is 12.

Figure 11:
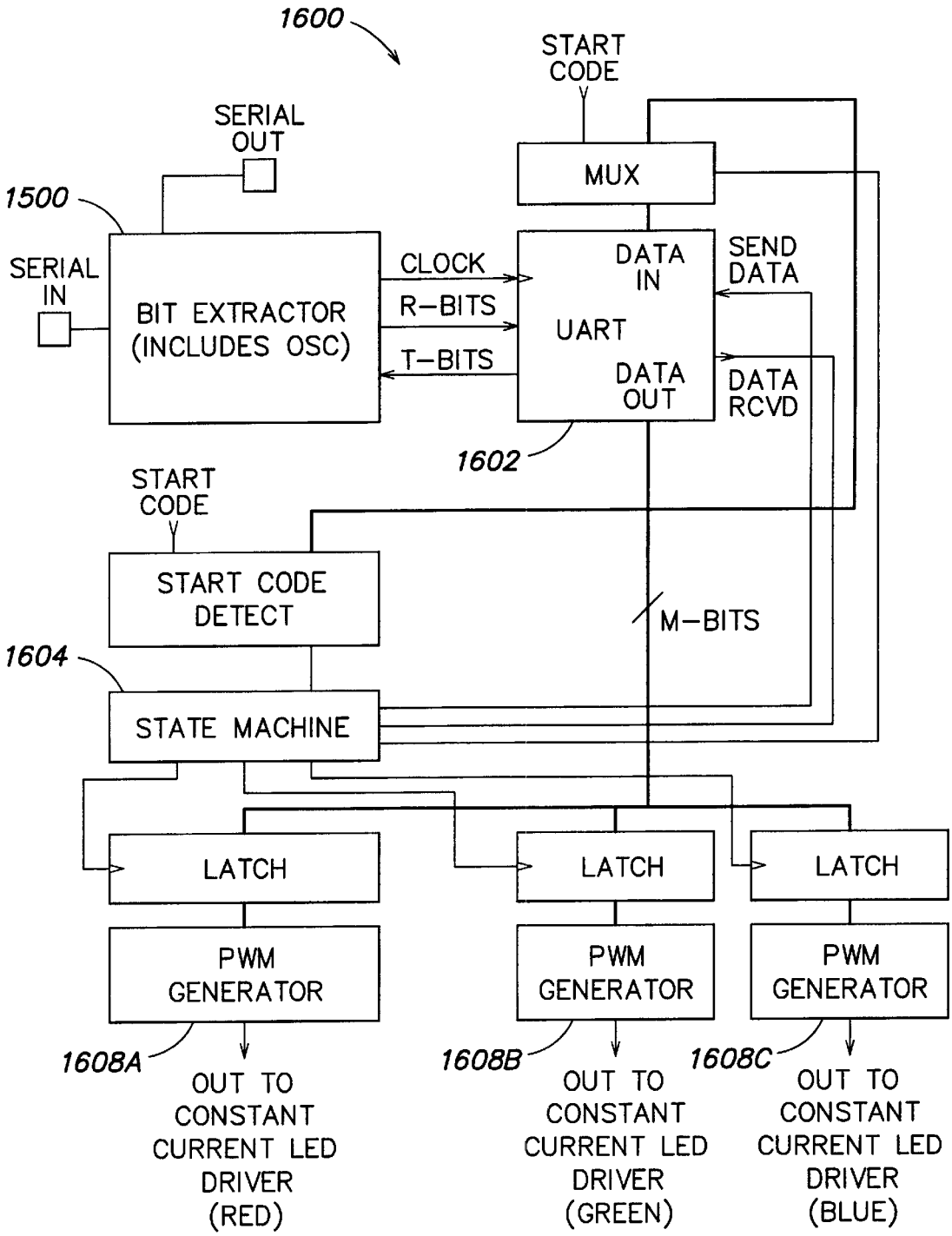
FIG. 11 illustrates a control circuit of a lighting system, according to one embodiment of the invention.

Similarly, in another aspect of this embodiment as shown in FIG. 11 which illustrates one exemplary circuit implementation 1600 of a controller 26, bits desired to be transmitted from a UART 1602 may be utilized to create a serial stream which may then be received by a another controller. The same latched period value, as previously described, may be utilized to create a second trigger value for a second equality detector 1512 (shown in FIG. 10). In various aspects, the trigger value may be ¼ for a zero bit or ¾ for a one bit, for example. These trigger values may be generated using a single N-bit adder. The input to the adder may be ¼ of the period, and ½ of the period value. Both of these component values require no actual logic to determine, and gating the ½ period value with the state of the bit to be transmitted results in the output of the adder being either ¼ of the period, or ¾ of the period. The second equality detector 1512 shown in FIG. 10 then triggers at the appropriate time to generate the falling edge of the output serial stream. Since the rising edge may simply be rising edge of the input serial stream, both the rising and falling edge triggers are thus available, and a Set-Reset flip flop 1514 may be used as shown in FIG. 10 to merge the signals into an output serial stream. In order to reduce delay in the RISE signal, in one embodiment, a second AND gate 1518 may be used as shown in FIG. 10 to bypass the first flip-flop of the rising edge detector.

One skilled in the art will appreciate that other proportions of the input period, or even fixed numbers, or other periods could be used instead of the fractional periods as discussed herein, as the invention is not limited to any particular manner of implementation. For example, in other embodiments, analog methods may be used to accomplish the function of extracting bits as described above in connection with FIGS. 10 and 11. In particular, the counter may be replaced by an analog ramp generator. The latch may be replaced by a sample and hold circuit. The multipliers may be replaced by tapped resistors or stacked capacitive voltage dividers. The equality detectors may be replaced by analog comparators. The adder may then be replaced by an analog MUX. The resulting circuit is capable of extracting the bits, and still generates the necessary UART clock. This example is provided to show that there are many circuits, both analog and digital and combinations of each, that may be assembled to make an integrated circuit or controller capable of performing the functions of the present invention described herein.

As stated previously, in connection with FIG. 11, the clock and data bits may be used to drive a UART 1602 to extract data words. One such word may be reserved as a "start code" to allow synchronization of data segments. As illustrated in FIG. 11, a state machine 1604, either implemented in software or in hardware, may then be used to distribute the received words to PWM generators 1608A, 1608B and 1608C, and to control the content of the transmitted data. In one embodiment, the state machine 1604 causes a start code to be sent when either start codes or the each of the first three subsequent words are received. This action causes the data stream to change as it passes from unit to unit, the number of start codes increasing, and the number of data bytes decreasing. Multiple start codes in succession may be ignored. The number of data bits per word may be changed by changing the widths of all of the component latches and UART registers. In a preferred embodiment an M of 8 bits is used.

In another embodiment, a controller for a lighting system may be capable of bi-directional communication. For example, modifying the serial in and serial out pin drivers of a controller (the input and output ports) to be bi-directional, and adding some control circuitry, would enable transmission in both directions. In one aspect of this embodiment, the serial out may be looped back to the serial in of the control device. Various other methods could be used including, but not limited to, power line carrier, RF, optical, acoustic and other means (e.g., transmitting the bits to the LEDs and monitoring the power consumption of the system for a change).

Figure 12:
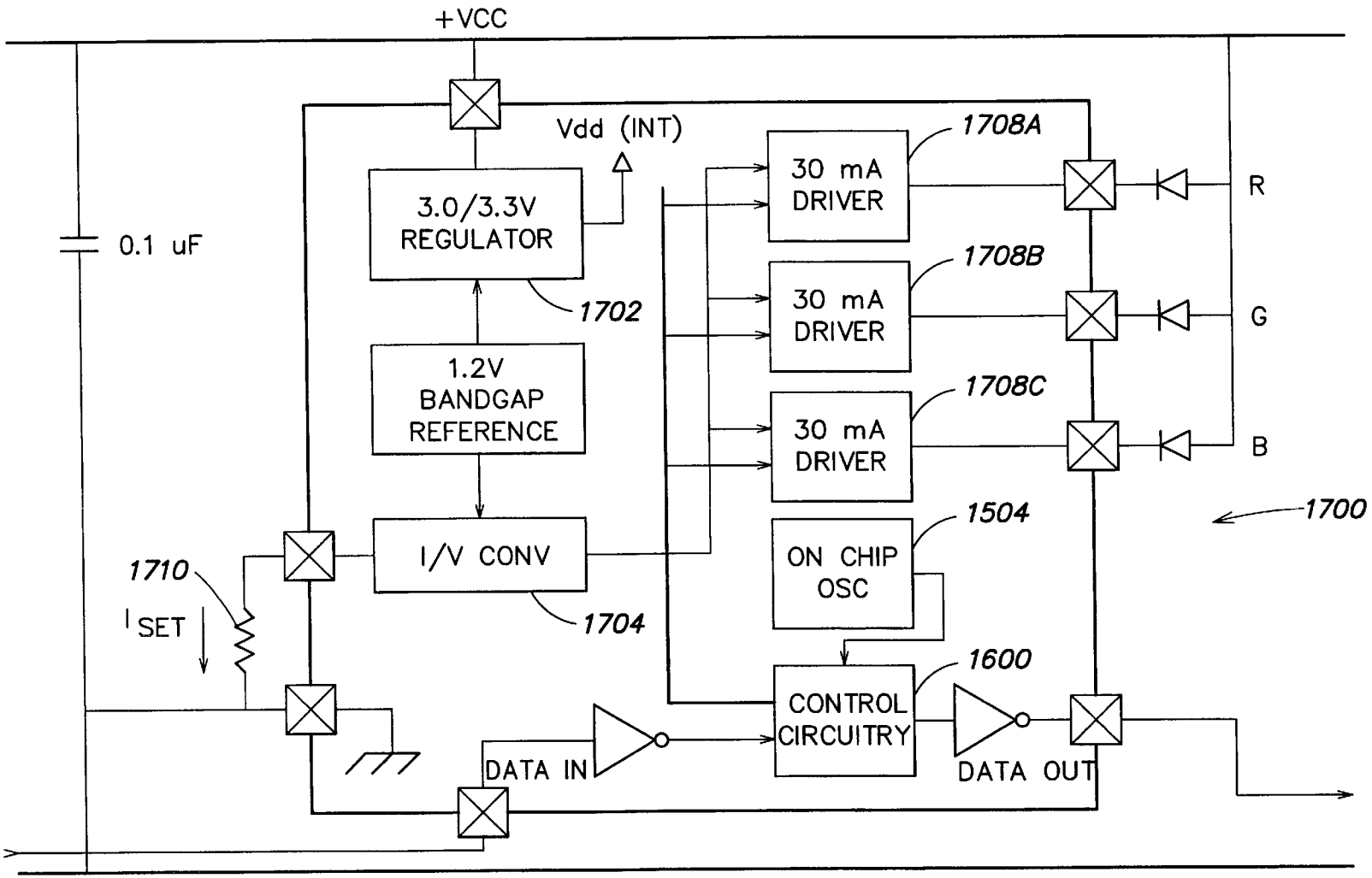
FIG. 12 illustrates an illumination regulation circuit, according to one embodiment of the invention.

FIG. 12 shows a power regulation circuit 1700 that may be employed with the circuit 1600 shown in FIG. 11 and/or incorporated into an integrated circuit or other type of controller according to one embodiment of the present invention. In the embodiment of FIG. 12, the regulator 1702 may be adapted to accept a voltage range, 4.5 to 13 volts for example, and output a regulated voltage, 3 volts +/−5% for example. The current to voltage converter 1704 may sense the current flowing through, or voltage across, an external resistor 1710 while it is driven by a reference to provide a tracking reference voltage or current to the driver devices 1708A, 1708B and 1708C. The driver devices 1708A, 1708B and 1708C may be adapted to accept the reference voltage or current from the I/V circuit 1704, and a bit of data. The bit of data may turn the driver on or off and when the driver is on it may deliver a fixed DC current of 30 mA for example. This arrangement provides for regulation of the illumination sources (e.g. LEDs) over a wide range of input voltages.

Figure 13:
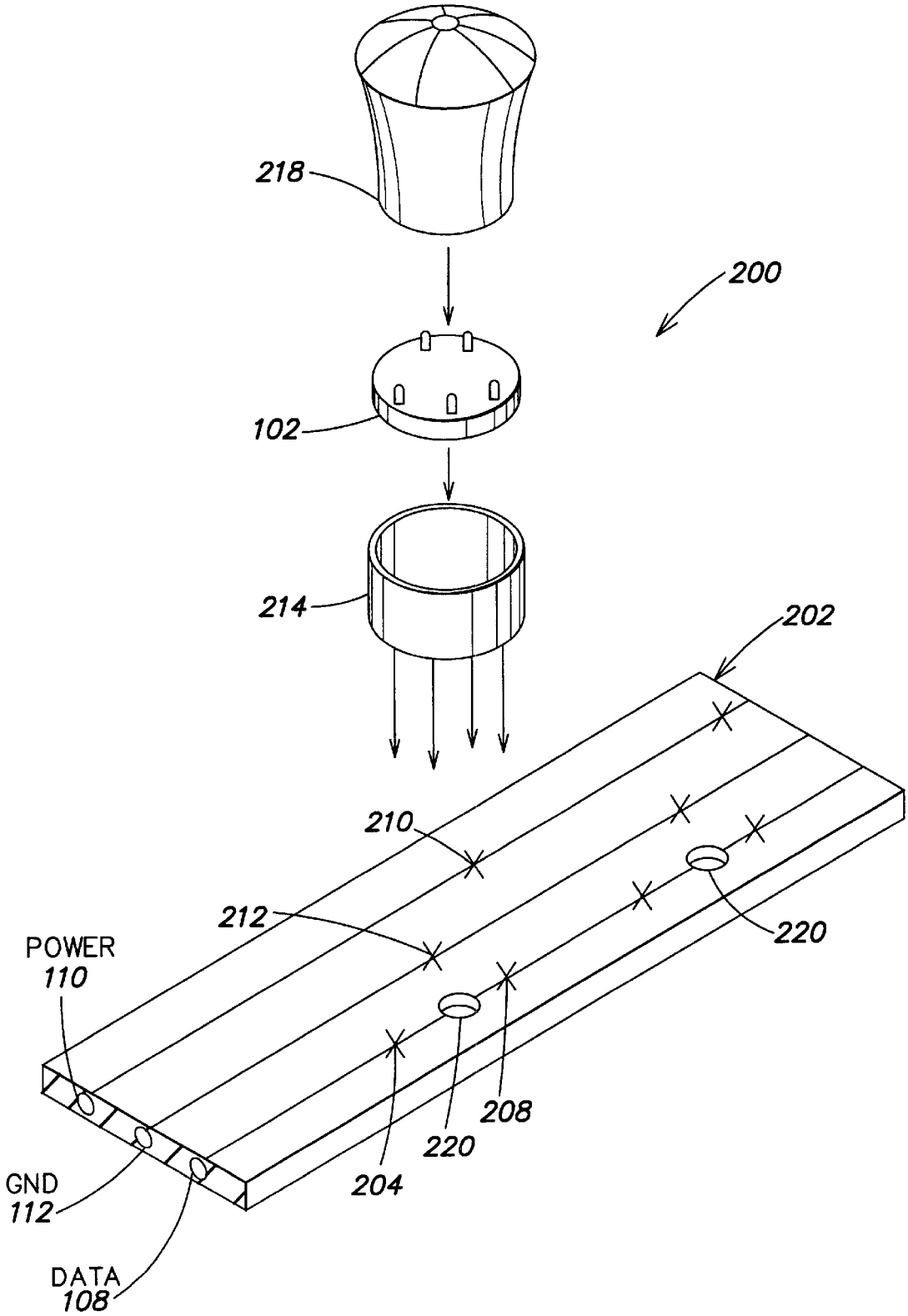
FIG. 13 illustrates a conduit arrangement for a lighting network, according to one embodiment of the invention.

FIG. 13 illustrates a lighting string 200 according to another embodiment of the present invention. In this embodiment, a conduit 202 includes conductors for power 110, ground 112 and data 108 running through the conduit 202. The conduit 202 may be a ribbon style cable for example. The data conductor 108 is periodically broken, as indicated by the holes 220 through the conduit and conductor 108. As indicated by the illustration, punching a hole 220 through the conduit 202 and the data conductor 108 may make the break in the data conductor 108. There are many other ways to break the data conductor 108 or present a data conductor that has breaks or interruptions and the present invention is not limited by these illustrative embodiments.

Figure 14A:
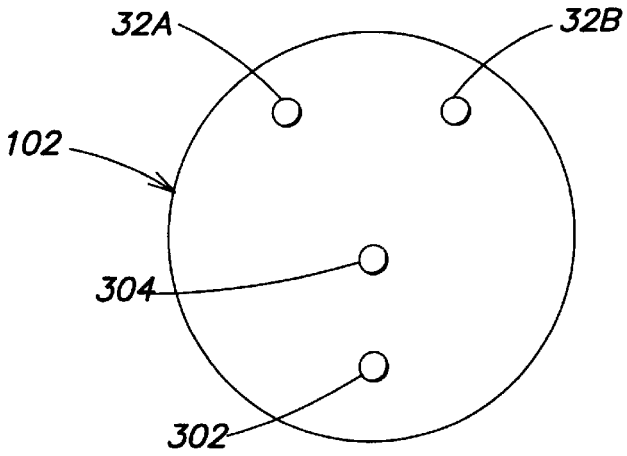
FIG. 14A illustrates the bottom side of a lighting system according to one embodiment of the invention.
Figure 14B:
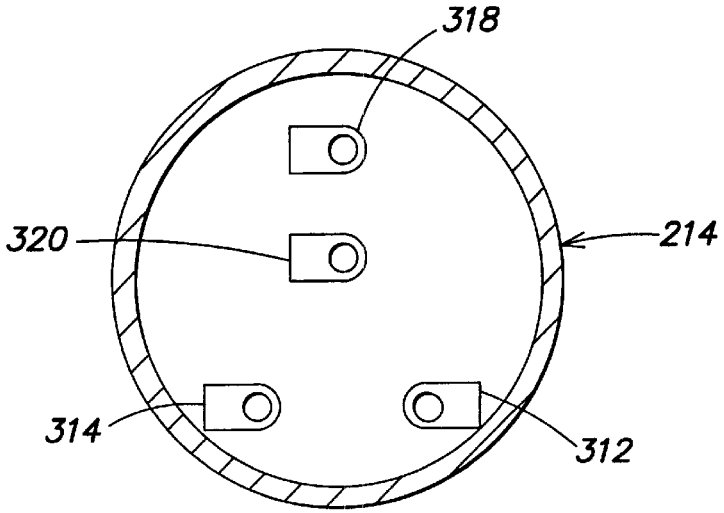
FIG. 14B illustrates a socket for a lighting system according to one embodiment of the invention.

In one aspect of the embodiment of FIG. 13, a light socket 214 may be coupled to the conduit 202. A lighting system 102 according to this embodiment may include a top side and a bottom side, wherein LEDs are mounted on the top side and electrical connectors pass through to the bottom side. A bottom side to such a lighting system 102 is illustrated in FIG. 14A. As shown in FIG. 14A, the bottom side of the lighting system 102 may include several electrical connectors, first data port 32A, second data port 32B, ground connector 304, and power connector 302, for example. These connectors 32A, 32B, 304, and 302 may be physically arranged to match a pattern of connectors 312, 314, 320 and 318 in socket 214, as shown in FIG. 14B. The connectors 312, 314, 320 and 318 of socket 214 may be arranged to be electrically connected with the conductors in the conduit 202.

In one aspect of this embodiment, the socket 214 may be positioned on the conduit 202, and screws or other electrically conductive fasteners may be used to electrically and physically connect the socket 214 to the conduit 202. Each of the connectors 312, 314, 320 and 318 of socket 214 may include holes, and the holes in the connectors may be aligned with holes 204, 208, 210 and 212 in the conduit 202, as shown in FIG. 13 in the socket 214 such that when a screw or other electrically conductive fastener is passed through the hole and into the conduit, an electrical connection is formed between the electrical connector of the socket and the electrical conductor of the conduit 202. In another aspect of this embodiment, the arrangement would electrically connect first data port 32A to one side of the broken data line 108 and second data port to the other side of the broken data line 108, such that the data line 108 circuit is completed through the lighting system 102. This arrangement would also electrically connect ground connector 304 to conductor 112 in the conduit 202 and power connector 302 to conductor 110 in the conduit 202.

With reference again to FIG. 13, in another embodiment, the lighting system 200 may include an optic 218 wherein the optic 218 is connected to the socket 214. In one aspect of this embodiment, the optic 218 is removeably connected to the socket 214. In another aspect, the optic 218 is sealably connected to socket 214 to prevent water from getting into socket 214. In yet another aspect, the socket may also be sealed at the electrical connectors or at the conduit 202 to socket 214 interface or on the reverse side of the conduit or through other means. For example, in one aspect, the screws that pass through the socket 214 into the conduit 202 create a seal as a result of the interference between the screw and the conduit.

Figure 15:
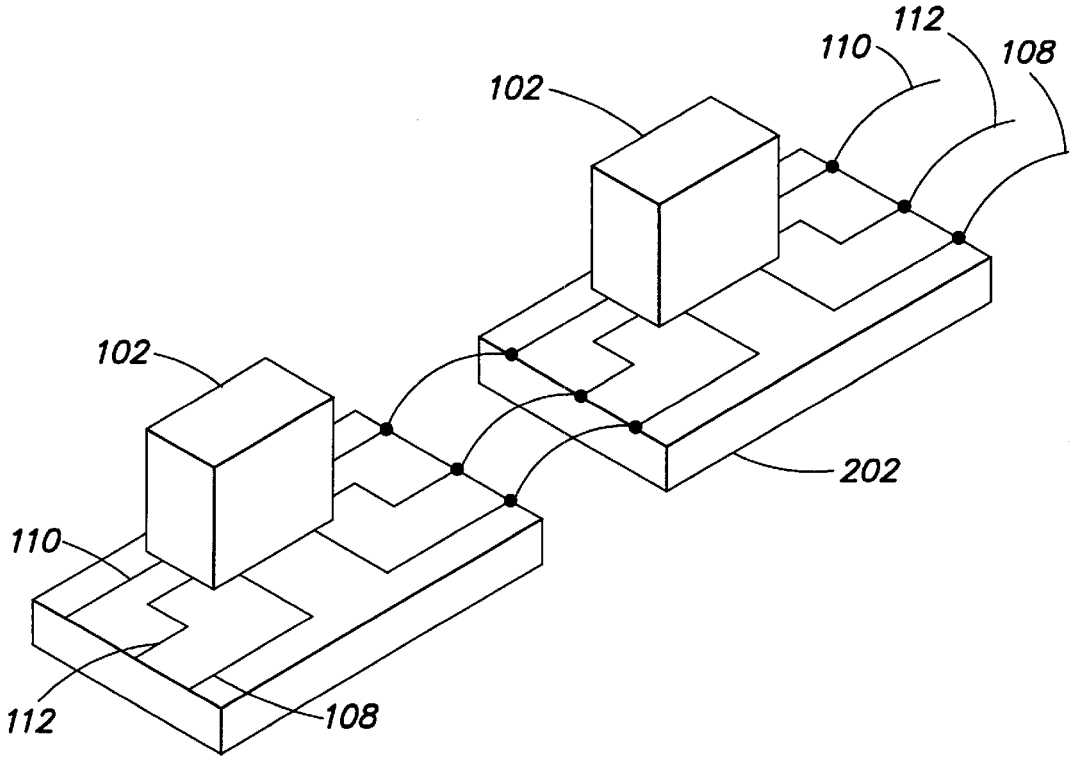
FIG. 15 illustrates another conduit arrangement for a lighting network according to one embodiment of the invention.

FIG. 15 illustrates yet another embodiment of the invention involving a conduit 202. In the embodiment of FIG. 15, the conduit may not encapsulate the conductors 110, 112 and 108. Instead, the conductors 110, 112 and 108 may, for example, reside on the outside of the conduit. In one aspect of this embodiment, the conduit may be a circuit board that includes breaks and connectors between the breaks between the lighting systems 102, as illustrated in FIG. 15.

Figure 16A:
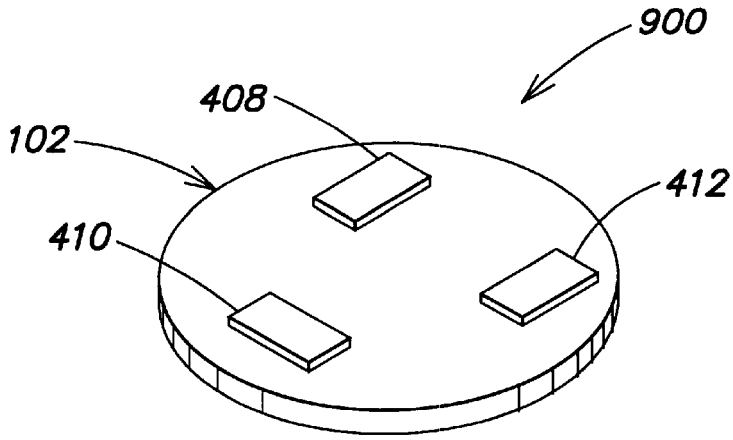
FIGS. 16A and 16B illustrate a lighting system according to another embodiment of the invention.
Figure 16B:
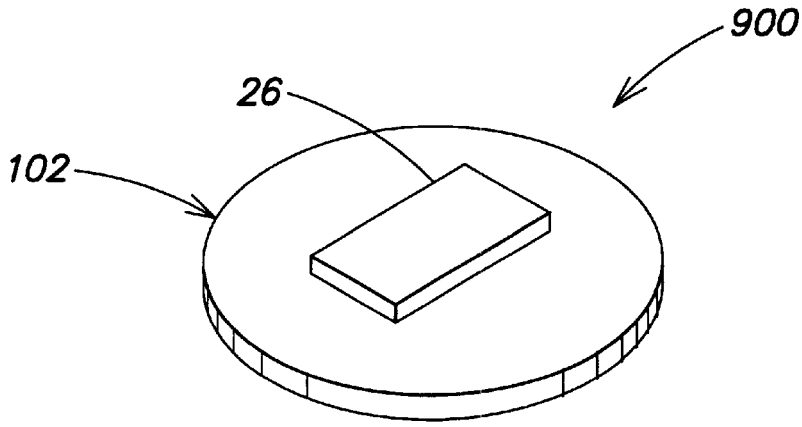

FIGS. 16A and 16B illustrate a lighting module 900 according to another embodiment of the present invention. The lighting module 900 may include a lighting system 102 as described above in various embodiments. In the embodiment of FIG. 16, the lighting module 900 may be very small in comparison to other embodiments of the invention. For example, the lighting module 900 shows three LEDs, 408, 410, and 412 (e.g. red, green and blue) on the top side of the lighting module 900 while a controller 26 of the lighting system 102 is located on the bottom or opposite module 900 may be so small that the three LEDs and the controller cannot fit on the same side. In one aspect of this embodiment, a lighting module 900 may be provided with one or more LEDs. The LEDs in an embodiment may comprise a die mounted directly on a platform, while the controller 26 may be a specifically fabricated integrated circuit designed for minimum size and low cost. The controller 26 may be associated with the LEDs on the opposite side of the platform such that independent control of the LEDs can be achieved. The LEDs may be controlled using PWM, analog, or other control techniques, as discussed herein.

Figure 17A:
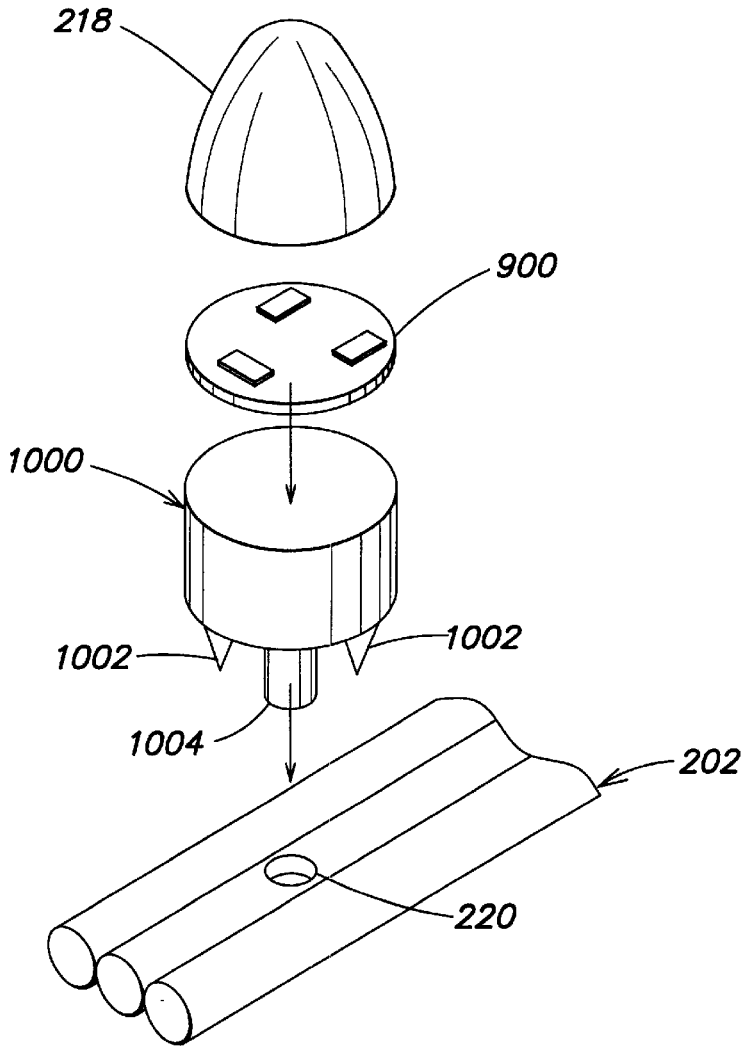
FIGS. 17A and 17B illustrate a packaging arrangement for the lighting system of FIG. 16, according to one embodiment of the invention.
Figure 17B:
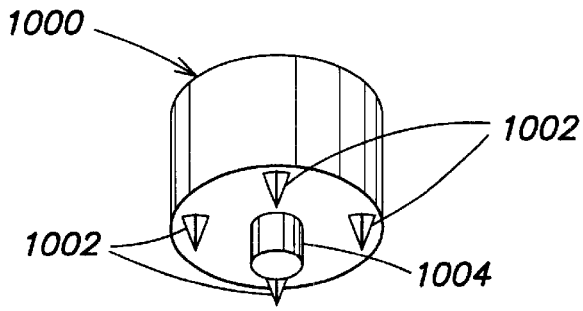

FIGS. 17A and 17B show a mounting block 1000 according to one embodiment of the present invention. The mounting block 1000 may be arranged to receive a lighting module 900 as discussed above in connection with FIGS. 16A and 16B, such that the contacts on the lighting module 900 align with contacts in the mounting block (not shown). In one aspect of this embodiment, several cutting contacts 1002 also may be provided on the bottom side of the mounting block 1000. The cutting contacts may be electrically conductive and sharp enough that they penetrate an insulation covering the conductors in a conduit 202 (discussed above) to form electrical connection between the conductors and the cutting contacts 1002 (e.g. an insulation displacement connector). In one aspect of this embodiment, the mounting block 1000 may be provided with four such cutting contacts 1002: one to connect to power, one to connect to common, one for data input and one for data output.

In the embodiment of FIGS. 17A and 17B, the mounting block 1000 may also be provided with a locating pin 1004. The locating pin 1004 may be used to align the block 1000 with a hole 220 in the conduit 202, and may also assist in pushing electrically conductive material out of the hole 220. In one aspect of this embodiment, the locating pin 1004 may be used to produce the hole in the conduit 220. The assembly in FIG. 17A also illustrates an optic 218 that may be used with the system. The optic 218 may also be used to capture the lighting module 900 in or on the block 1000. In another aspect of this embodiment, the mounting block 1000 may also be associated with an attachment device (not shown) to secure the block 1000 to the conduit 202.

Applicants have recognized and appreciated that very small color changing lighting system in the form of a light string according to the principles of the present invention may be used in place of conventional light ropes, Christmas tree lights, decorative lights, display lights or other lighting systems. For example, a string lighting system may be used to provide complex lighting effects in or on a display such as chasing effects, coordinated effects, color changing effects or other lighting effects. A controller may be provided and associated with the lighting string such that network signals are communicated in a serial fashion, wherein each lighting module or system responds to the serially arranged data as described herein.

Yet another embodiment of the present invention, in connection with FIGS. 16A and 16B and 17A and 17b for example, is directed to a method of manufacturing a light string. The method comprises the steps of providing a conduit 220 with three conductors 110, 112, 108, punching a hole 220 through one of the conductors, attaching a mounting block 1000 wherein a locator pin 1004 is inserted through the hole 220, mounting a lighting module 900 in the mounting block 1000 and securing a lens to the mounting block. The cutting contacts 1002 may be pressed through the insulation on wires of the conduit 202 to make electrical contact. There are many variations of this manufacturing technique and such variations are encompassed by the present invention.

Another aspect of the present invention is that one or more of the controllers and/or processors discussed herein may be implemented as an integrated circuit (IC) designed to control an illumination source through network data. The IC may be desirous in many applications where size, cost and/or simplicity of design are important. For example, an IC may be used in an application where the illumination device needs to be very small. In various embodiments, an IC is used in conjunction with one or more LEDs to form an illumination system and many such systems may be strung together to form large networks of controllable illumination sources. In one aspect of this embodiment, reduced size may be important and an illumination system may be created wherein an IC is attached to one side of a platform and at least one LED is attached to the opposite side of the platform and the platform may be sized to accommodate the LED(s) and the IC. For example, three surface mount, chip on board, LED dies, or other small LED constructions, may be attached to one side of the platform and the IC on the opposite side with the electrical connections passing from the IC to the LEDs. If different colored LEDs are used, the IC may be programmed to generate combinations of colors from the two colors. In an embodiment, the platform may have a first side surface area of 0.5 square inches or less.

In an embodiment, the IC may be mounted on a platform with at least one LED on the opposite side of the platform, although the LED(s) and the IC may be on the same side, and the platform may be associated with a housing. The housing may be adapted to pass through data in and data out ports from the IC with a data connection, as described herein, to allow a data stream to be communicated to the IC and to allow the IC to transmit the data stream, or portion thereof or modified data stream, to another illumination device. In an embodiment the housing may also be associated with an optic 218 and the optic 218 may be adapted to diffuse the light, redirect the light, generate a prismatic effect or other wise affect the generated light. In an embodiment, color mixing may be important and the transmission of the optic may be reduced to increase the mixing properties of the optic 218. For example, the optic 218 may have transmission properties of between 10 and 90% optimized for the specific application. In another embodiment, the optic 218 may be transparent or nearly transparent.

Another embodiment of the present invention is directed to a controller 26 or IC that is adapted to handle variations in power. Applicants have recognized and appreciated various problems associated with delivering adequate power to the controller, IC and/or illumination components when many such systems are strung together. In one embodiment, a plurality of illumination systems may be associated with each other in a "string." The string may become long, relative to a power supplies capability of supplying constant power to the entire string. For example, a string may be long enough that the power transmission lines, along with the illumination systems drawing power from the transmission lines, cause the power to drop significantly as the lines get longer. In one aspect of this embodiment, the IC, or other system controlling the illumination source, may be adapted with a power management circuit wherein the power management circuit is adapted to receive power from a power source, control the power from the power source and deliver adequate power to another circuit in the integrated circuit. Depending on the system needs, the power management circuit may be adapted to deliver adequate power when the power delivered to the power management system varies by a significant amount. For example, the power management circuit may be adapted to deliver adequate power when the power delivered varies by up to 90%. In an embodiment, the power management circuit may be adapted to handle relatively small increases in the supply voltage but capable of supplying adequate power over large negative variations in the delivered power. This may be so arranged, for example, to accommodate for the anticipated voltage drop as the string gets longer while not compensating for large swings in supply voltage on the positive side.

As used herein for purposes of the present disclosure, the term "LED" should be understood to include light emitting diodes of all types (including semi-conductor and organic light emitting diodes), semiconductor dies that produce light in response to current, light emitting polymers, electro-luminescent strips, and the like. Furthermore, the term "LED" may refer to a single light emitting device having multiple semiconductor dies that are individually controlled. It should also be understood that the term "LED" does not restrict the package type of an LED; for example, the term "LED" may refer to packaged LEDs, non-packaged LEDs, surface mount LEDs, chip-on-board LEDs, and LEDs of all other configurations. The term "LED" also includes LEDs packaged or associated with phosphor, wherein the phosphor may convert radiant energy emitted from the LED to a different wavelength.

Additionally, as used herein, the term "light source" should be understood to include all illumination sources, including, but not limited to, LED-based sources as defined above, incandescent sources (e.g., filament lamps, halogen lamps), pyro-luminescent sources (e.g., flames), candle-luminescent sources (e.g., gas mantles), carbon arc radiation sources, photo-luminescent sources (e.g., gaseous discharge sources), fluorescent sources, phosphorescent sources, high-intensity discharge sources (e.g., sodium vapor, mercury vapor, and metal halide lamps), lasers, electro-luminescent sources, cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers capable of producing primary colors.

Furthermore, as used herein, the term "color" should be understood to refer to any frequency (or wavelength) of radiation within a spectrum; namely, "color" refers to frequencies (or wavelengths) not only in the visible spectrum, but also frequencies (or wavelengths) in the infrared, ultraviolet, and other areas of the electromagnetic spectrum.

Having thus described several illustrative embodiments of the invention, various alterations, modifications, and improvements will readily occur to those skilled in the art. Such alterations, modifications, and improvements are intended to be within the spirit and scope of the invention. Accordingly, the foregoing description is by way of example only, and is not intended as limiting. The invention is limited only as defined in the following claims and the equivalents thereto.

What is claimed is:

1. A lighting system, comprising:

an LED lighting system adapted to receive a data stream through a first data port, generate at least one illumination condition based on at least a first portion of the data stream, and communicate at least a second portion of the data stream through a second data port; and a housing adapted to retain the LED lighting system and electrically associate the first and second data ports with a data connection comprising an electrical conductor with at least one discontinuous section having a first side and a second side that is electrically isolated from the first side, the housing being adapted such that the first data port is electrically associated with the first side of the discontinuous section and the second data port is electrically associated with the second side of the discontinuous section.

2. The system of claim 1 wherein the housing further comprises a feature used to align the housing with data connection.

3. The system of claim 2 wherein the feature is adapted to align the housing with the at least one discontinuous section.

4. The system of claim 3 wherein the feature comprises a protrusion wherein the protrusion is inserted into the discontinuous section.

5. The system of claim 1 wherein at least one of the first data port and the second data port is electrically associated with the data connection through a insulation displacement connector.

6. The system of claim 1 wherein at least one of the first data port and the second data port is electrically associated with the data connection through a fastener.

7. The system of claim 1 wherein the electrical association of at least one of the first data port and the second data port also provides mechanical attachment; wherein the mechanical attachment is sufficient to secure the housing to the data connection.

8. The system of claim 1 wherein the LED lighting system is adapted to strip the first portion from the data stream.

9. The system of claim 8 wherein the LED lighting system is further adapted to communicate at least an unstripped portion of the data stream to another system.

10. The system of claim 1 wherein the LED lighting system is adapted to manipulate the first portion of the data stream.

11. The system of claim 10 wherein the LED system is further adapted to communicate at least the manipulated first portion of the data stream.

12. The system of claim 11 wherein the LED system is further adapted to communicate at least an unmanipulated portion of the data stream.

13. The system of claim 1 wherein the LED lighting system is adapted to modify the first portion of the data stream.

14. The system of claim 13 wherein the LED lighting system is adapted to modify the first portion of the data stream by changing at least one bit of the first portion.

15. The system of claim 13 wherein the LED lighting system is adapted to modify the first portion of the data stream by adding at least one bit to the first portion.

16. The system of claim 13 wherein the first portion comprises a packet of data.

17. The system of claim 16 wherein the packet of data comprises the first unmodified packet of data received by the LED lighting system.

18. The system of claim 13 wherein the LED lighting system is adapted communicate at least the modified portion to another system.

19. The system of claim 1 wherein the LED lighting system is adapted to read a first portion of the data stream; wherein the first portion comprises a data packet.

20. The system of claim 19 wherein the data packet comprises a first packet of data received through the data stream.

21. The system of claim 19 wherein the data packet comprises a first unmodified data packet received through the data stream.

22. The system of claim 19 wherein the data packet is associated with identification data.

23. The system of claim 22 wherein the identification data indicates the status of the data packet.

24. The system of claim 23 wherein the status indicates weather the data packet has been previously read by another system.

25. The system of claim 1 wherein the LED lighting system comprises a single color producing LED lighting system adapted to change the intensity of the color in response to the read portion of the data stream.

26. The system of claim 1 wherein the LED lighting system comprises a muli-color producing LED lighting system adapted to change at least one of an intensity and a color of the light produced by the LED lighting system in response to the first portion of the data stream.

27. The system of claim 26 wherein the LED lighting system controls LEDs through at least one of an analog control signal; PWM control, and current control signal.

28. The system of claim 26 wherein the LED lighting system comprises at least two different color producing LEDs and the LED lighting system independently controls the at least two different color producing LEDs.

29. The system of claim 1 wherein the LED lighting system further comprises a platform wherein at least one LED and a processor are mounted on the platform; and the housing retains the platform.

30. The system of claim 29 wherein the platform comprises a top side and a bottom side; wherein the processor is associated with the bottom side and the at least one LED is associated with the top side.

31. The system of claim 30 wherein the at least one LED comprises a plurality of LEDs.

32. The system of claim 31 wherein the plurality of LEDs comprises at least two different color producing LEDs.

33. The system of claim 31 wherein the plurality of LEDs comprises red, green and blue producing LEDs.

34. The system of claim 30 wherein the platform has a top side surface area smaller than approximately 0.5 square inches.

35. The system of claim 30 wherein the platform has a top side surface area smaller than approximately 0.25 square inches.

36. The system of claim 30 wherein the platform has a top side surface area smaller than approximately 0.2 square inches.

37. The system of claim 30 wherein the platform has a top side surface area smaller than approximately 0.15 square inches.

38. The system of claim 30 wherein the platform has a top side surface area smaller than approximately 0.1 square inches.

39. The system of claim 30 wherein the platform has a top side surface area smaller than approximately 0.05 square inches.

40. The system of claim 1 further comprising an optic arranged in optical association with at least one LED of the LED lighting system.

41. The system of claim 40 wherein the at least one LED comprises a plurality of LEDs of at least two different colors; wherein the optic is adapted to mix the light produced by the LEDs of at least two different colors.

42. The system of claim 41 wherein the optic is at least one of transparent, translucent, partially transparent, partially translucent.

43. The system of claim 41 wherein the transmission of the optic is greater than approximately 10%.

44. The system of claim 41 wherein the transmission of the optic is greater than approximately 20%.

45. The system of claim 41 wherein the transmission of the optic is greater than approximately 30%.

46. The system of claim 41 wherein the transmission of the optic is greater than approximately 40%.

47. The system of claim 41 wherein the transmission of the optic is greater than approximately 50%.

48. The system of claim 41 wherein the transmission of the optic is greater than approximately 60%.

49. The system of claim 41 wherein the transmission of the optic is greater than approximately 70%.

50. The system of claim 41 wherein the transmission of the optic is greater than approximately 80%.

51. The system of claim 41 wherein the transmission of the optic is greater than approximately 90%.

52. The system of claim 41 wherein the transmission of the optic is approximately 100%.

53. The system of claim 40 wherein the optic comprises at least one of glass, plastic, and polycarbonate.

54. The system of claim 40 wherein the optic is adapted to produce a prismatic effect.

55. A plurality of lighting systems of claim 1 wherein the data connection connects the plurality of lighting systems in series.

56. The plurality of lighting systems of claim 55 wherein the plurality is arranged on a surface.

57. The plurality of lighting systems of claim 56 wherein the surface comprises a buildings exterior surface.

58. The plurality of lighting systems of claim 56 wherein the surface comprises a buildings interior surface.

59. The plurality of lighting systems of claim 55 wherein the plurality of lighting systems is arranged to illuminate a cove.

60. The plurality of lighting systems of claim 55 wherein the plurality of lighting systems is arranged to illuminate a walkway.

61. The plurality of lighting systems of claim 55 wherein the plurality of lighting systems is arranged to illuminate a pathway.

62. The plurality of lighting systems of claim 55 wherein the plurality of lighting systems is arranged to illuminate a tree.

63. The plurality of lighting systems of claim 55 wherein the plurality of lighting systems is arranged to illuminate a Christmas tree.

64. The plurality of lighting systems of claim 55 wherein the plurality of lighting systems is arranged as a part of a game.

65. The plurality of lighting systems of claim 55 wherein the plurality of lighting systems is arranged as part of a video game.

66. The plurality of lighting systems of claim 55 wherein the plurality of lighting systems is arranged as part of a jukebox.

67. The plurality of lighting systems of claim 55 wherein the plurality of lighting systems is arranged as part of a gambling machine.

68. The plurality of lighting systems of claim 55 wherein the plurality of lighting systems is arranged as part of a slot machine.

69. The plurality of lighting systems of claim 55 wherein the plurality of lighting systems is arranged as part of a pinball machine.

70. A method of controlling a plurality of lighting systems, comprising acts of:

communicating a data stream to a first lighting system of the plurality of lighting systems;

receiving the data stream at the first lighting system and reading at least a first portion of the data stream;

generating at least one lighting effect at the first lighting system in response to the first portion of the data stream; and communicating at least a second portion of the data stream to a second lighting system of the plurality of lighting systems.

71. The method of claim 70 wherein the plurality of lighting systems comprise a plurality of LED lighting systems.

72. The method of claim 70 wherein the plurality of lighting systems comprise a plurality of illumination systems.

73. The method of claim 70 wherein the plurality of lighting systems comprise a plurality of non-LED lighting systems.

74. The method of claim 70 wherein the plurality of lighting systems comprise a plurality of color changing LED lighting systems.

75. The method of claim 70, further comprising the step of:

causing the first lighting system to strip the first portion of the data stream from the data stream; and wherein the step of causing the first lighting system to communicate at least a second portion of the data stream to second lighting system of the plurality of lighting systems comprises causing the first lighting system to communicate at least a second portion of the data stream to second lighting system of the plurality of lighting systems; wherein the second portion of the data stream does not include the first portion.

76. The method of claim 70, further comprising the step of:

causing the first lighting system to modify the first portion of the data stream such that the remaining lighting systems in the plurality of lighting systems recognize the first portion has been read by the first lighting system; and wherein the step of causing the first lighting system to communicate at least a second portion of the data stream to another of the plurality of lighting systems comprises causing the first lighting system to communicate at least a second portion of the data stream to another of the plurality of lighting systems; wherein the second portion of the data stream includes the modified first portion of the data stream.

77. The method of claim 76 wherein the step of causing the first lighting system to modify the first portion of the data stream such that the remaining lighting systems in the plurality of lighting systems recognize the first portion has been read by the first lighting system comprises causing the first lighting system to modify the first portion of the data stream with an extra bit such that the remaining lighting systems in the plurality of lighting systems recognize the first portion has been read by the first lighting system.

78. The method of claim 76 wherein the step of causing the first lighting system to modify the first portion of the data stream such that the remaining lighting systems in the plurality of lighting systems recognize the first portion has been read by the first lighting system comprises causing the first lighting system to modify a bit of the first portion of the data stream such that the remaining lighting systems in the plurality of lighting systems recognize the first portion has been read by the first lighting system.

79. The method of claim 70 wherein the data stream comprises a plurality of data packets;

wherein the step of causing the first lighting system to receive the data stream and to read a first portion of the data stream comprises causing the first lighting system to receive the data stream and to read a first unread data packet from the data stream; and wherein the step of causing the first lighting system to generate a lighting effect in response to the first portion of the data stream comprises causing the first lighting system to generate a lighting effect in response to the first unread data packet from the data stream.

* * * * *

UNITED STATES PATENT AND TRADEMARK OFFICE

CERTIFICATE OF CORRECTION

PATENT NO. : 6,777,891 B2
DATED : August 17, 2004
INVENTOR(S) : Ihor A. Lys et al.

It is certified that error appears in the above-identified patent and that said Letters Patent is hereby corrected as shown below:

Title page,

Item [75], Inventors, should read as follows:

-- Inventors: Ihor A. Lys, Milton, MA (US);
Frederick M. Morgan, Quincy, MA (US) --

Item [63], Related U.S. Application Data, should read as follows:

Continuation-in-part of application No. 09/971,367, filed on Oct. 4, 2001, which is a continuation of application No. 09/669,121, filed on Sep. 25, 2000, which is a continuation of application No. 09/425,770, filed on Oct. 22, 1999, now Pat. No. 6,150,774, which is a continuation of application No. 08/920,156, filed on Aug. 26, 1997, now Patent No. 6,016,038. Continuation-in-part of application No. 09/870,193, filed on May 30, 2001, now Pat. No. 6,608,453, and a continuation-in-part of application No. 09/815,418, filed on Mar. 22, 2001, now Pat. No. 6,577,080, which is a continuation of application No. 09/213,548, filed on Dec. 17, 1998, now Pat. No. 6,166,496. Continuation-in-part of application No. 09/333,739, filed on Jun. 15, 1999, and a continuation-in-part of application No. 09/215,624, filed on Dec. 17, 1998, now Pat. No. 6,528,954, and a continuation-in-part of application No. 09/213,607, filed on Dec. 17, 1998, now abandoned, and a continuation-in-part of application No. 09/213,189, filed on Dec. 17, 1998, now Pat. No. 6,459,919, and a continuation-in-part of application No. 09/213,581, filed on Dec. 17, 1998, and a continuation-in-part of application No. 09/213,540, filed on Dec. 17, 1998. Provisional application No. 60/341,476, filed on Oct. 30, 2001, provisional application No. 60/328,867, filed on Oct. 12, 2001, provisional application No. 60/301,692, filed on Jun. 28, 2001, provisional application No. 60/090,920, filed on Jun. 26, 1998, provisional application No. 60/079,285, filed on Mar. 25, 1998, provisional application No. 60/078,861, filed on Mar. 20, 1998, provisional application No. 60/068,792, filed on Dec. 24, 1997, and provisional application No. 60/071,281, filed on Dec. 17, 1997.

Item [56], References Cited, U.S. PATENT DOCUMENTS, please add the following references:

| | | |
|---|---|---|
| -- 5,418,697 | 5/1995 | Chiou |
| 5,607,227 | 3/1997 | Yasumoto et al. |
| 5,653,529 | 8/1997 | Spocharski |
| 6,056,420 | 5/2000 | Wilson et al. |
| 6,158,882 | 12/2000 | Bischoff Jr. |
| 6,283,612 | 9/2001 | Hunter |
| 6,371,637 | 4/2002 | Atchinson |
| 2002/0060526 A1 | 5/2002 | Timmermans et al. -- |

Signed and Sealed this

Second Day of November, 2004

JON W. DUDAS
*Director of the United States Patent and Trademark Office*